US007967541B2

(12) United States Patent
Stroshein et al.

(10) Patent No.: US 7,967,541 B2
(45) Date of Patent: Jun. 28, 2011

(54) APPARATUS FOR HANDLING AND RACKING PIPES

(75) Inventors: William John Stroshein, Calgary (CA); David Louis Richard, Calgary (CA); Monte Neil Wright, Calgary (CA); Leon Keith Jantzen, Calgary (CA); Imad Assaf, Calgary (CA)

(73) Assignee: Weatherford Canada Partnership, Calgary, Alberta (CA)

( * ) Notice: Subject to any disclaimer, the term of this patent is extended or adjusted under 35 U.S.C. 154(b) by 189 days.

(21) Appl. No.: 12/385,282

(22) Filed: Apr. 3, 2009

(65) Prior Publication Data

US 2009/0257848 A1 Oct. 15, 2009

Related U.S. Application Data

(63) Continuation-in-part of application No. 11/785,446, filed on Apr. 18, 2007, now Pat. No. 7,794,192, which is a continuation-in-part of application No. 10/997,930, filed on Nov. 29, 2004, now Pat. No. 7,331,746.

(51) Int. Cl.
*E21B 19/00* (2006.01)

(52) U.S. Cl. ..... 414/22.65; 414/22.68; 414/917; 414/22.63

(58) Field of Classification Search ..... 175/52, 175/85; 211/70.4; 212/195, 260, 279, 317; 414/22.51, 22.63, 22.64, 22.65, 22.66, 22.67, 414/22.68, 22.69, 22.71, 348, 626, 696, 733, 414/734, 735, 744.2, 744.3, 744.6, 751.1, 917; 901/14, 48

See application file for complete search history.

(56) References Cited

U.S. PATENT DOCUMENTS

| | | | | | |
|---|---|---|---|---|---|
| 1,118,817 | A | * | 11/1914 | Sheehan et al. | 212/260 |
| 2,662,797 | A | * | 12/1953 | Moon | 182/114 |
| 3,633,771 | A | | 1/1972 | Woolslayer et al. | |
| 3,710,954 | A | | 1/1973 | Hutchison | |
| 3,840,128 | A | | 10/1974 | Swoboda, Jr. et al. | |
| 3,885,679 | A | | 5/1975 | Swoboda, Jr. et al. | |
| 4,013,178 | A | | 3/1977 | Brown et al. | |
| 4,077,525 | A | | 3/1978 | Callegari et al. | |
| 4,117,941 | A | | 10/1978 | McCleskey, Jr. et al. | |
| 4,163,625 | A | * | 8/1979 | Jenkins | 414/22.63 |
| 4,177,002 | A | * | 12/1979 | Motoda et al. | 414/751.1 |
| 4,274,778 | A | | 6/1981 | Putnam et al. | |
| 4,440,262 | A | * | 4/1984 | Hunt et al. | 182/114 |
| 4,531,875 | A | | 7/1985 | Krueger | |
| 4,610,315 | A | * | 9/1986 | Koga et al. | 175/85 |
| 4,621,974 | A | | 11/1986 | Krueger | |
| 4,652,195 | A | | 3/1987 | McArthur | |
| 4,725,179 | A | | 2/1988 | Woolslayer et al. | |
| 4,765,401 | A | | 8/1988 | Boyadjieff | |
| 5,037,267 | A | * | 8/1991 | Warner et al. | 414/744.6 |
| 5,183,366 | A | | 2/1993 | Paech | |
| 5,186,343 | A | * | 2/1993 | Bozzi | 212/291 |
| 5,458,454 | A | | 10/1995 | Sorokan | |

(Continued)

FOREIGN PATENT DOCUMENTS

WO WO 01/23701 A1 4/2001

*Primary Examiner* — Gregory W Adams

(74) *Attorney, Agent, or Firm* — Antony C. Edwards

(57) ABSTRACT

An apparatus for handling pipes in a derrick and racking the pipes on a pipe racking assembly mounted on the derrick is provided to improve the stability of transferring pipes during a round trip operation.

12 Claims, 30 Drawing Sheets

U.S. PATENT DOCUMENTS 6,220,807 B1 4/2001 Sorokan
6,543,551 B1 4/2003 Sparks et al.
6,550,128 B1 * 4/2003 Lorenz ..... 29/464
6,821,071 B2 11/2004 Woolslayer et al.
6,926,488 B1 8/2005 Bolding et al.
2004/0057815 A1 * 3/2004 Woolslayer et al. ..... 414/22.63
2006/0113073 A1 * 6/2006 Wright et al. ..... 166/77.51
2007/0193750 A1 * 8/2007 Wright et al. ..... 166/379

* cited by examiner 46
54
56
60
52
52a
58
52b
54a
54b
56b
39
E

APPARATUS FOR HANDLING AND RACKING PIPES

CROSS REFERENCE TO RELATED APPLICATIONS

This application is a continuation-in-part of patent application Ser No. 11/785,446 filed Apr. 18, 2007 now U.S. Pat. No. 7,794,192, which is a continuation-in-part of patent application Ser. No. 10/997,930 filed Nov. 29, 2004, now U.S. Pat. No. 7,331,746 which issued Feb. 19, 2008.

FIELD OF THE INVENTION

This invention relates to the field of equipment used in the drilling industry, and more particularly, it relates to an apparatus for manipulating and racking pipes in a drilling derrick.

BACKGROUND OF THE INVENTION

In drilling operations, the derrick is the structure designed to support and manipulate the drill string in and out of the well bore. The drill string is a series of drill pipe segments or joints detachably connected together. Typically, the drill pipe joints are coupled together to form a pipe stand consisting of two or three joints of pipe. The stands are then coupled together to form the drill string.

Drill collars and a drill bit are attached to a drill end of the drill string. The drill collars are heavier pipes having a larger diameter. They connect to the drill pipe and place weight on the drill bit such that the downward force from the weight of the drill string, drill collars, and drill pipe on the drill bit assists in the drilling process. As the drill bit and drill string rotate and penetrate into the well bore, additional lengths of pipe may be connected to the coupling end of the drill string. Each pipe segment or joint is typically thirty or forty five feet in length (Range 2-30 feet, Range 3-45 feet). The joints are coupled into double stands of approximately 60-65 feet or, for larger operations, triple stands (Range 2) of 90 feet.

Because the drill bit has to be changed after a few days or even a few hours, depending on the hardness of the matter being drilled through, the drill string must be tripped out of the hole frequently. This involves withdrawing the drill string from the well bore by conventional hoisting means such as a winch (draw works) mounted to the derrick or substructure, uncoupling the pipe stands of the drill string using a power wrench, rotary table, top drive or other torqueing and rotary machinery, and then standing the pipe stands in a conventional pipe storage or racking assembly such as a so-called racking board or finger board assembly. In larger operations, the drill string can weigh several hundred tones and requires an extremely powerful motor housed in the draw works to withdraw the drill string from the well bore. The pipe stands are then transmitted between the well bore, that is well center in the derrick, to and from the storage assembly. After replacing the bit, the pipe stands are removed from the storage assembly by the or derrickman and transported back to the well center where the pipe stands are re-coupled with the drill string and lowered back down the well bore to recommence drilling. Known as a "round trip", this operation can take up to ten hours or more, depending on the depth of the well.

For decades, triple rigs have been used for drilling deeper holes than double rigs; triple rigs will not have fewer trips but there will be fewer connections between stands, and therefore less time is required to trip with a triple rig than a double rig for any particular depth. Further, a triple rig will hold ⅓ more pipe in the same size racking board and set back floor space as a double rig.

Present methods of manual tripping on both double and triple rigs require a person to stand on the racking board for the duration of the round trip, manually pulling back the stands or feeding the stands to the elevators so the stand can be lifted by the drawworks. This can be reasonably efficient when done by a skilled derrickman but, especially on a 10 or 12 hour round trip, it will be exhausting. This has been, and is presently, the predominant method of tripping on double and triple land rigs.

Automation of processes improves personnel safety and operating efficiencies. To automate the drilling and tripping processes, personnel must be removed from the rig floor and the racking board. In recent years there have been a number of mechanized products brought to market that remove personnel from the rig floor but racking of pipe while tripping has not changed—a person must still stand on the racking board for the time it takes to round trip.

The present invention eliminates the need for anyone to go up to the racking board while tripping pipe. Safety and efficiencies of the tripping process are thus improved.

Offshore drilling rigs have, for a number of years, used mechanized pipe racking systems. Equipment on offshore installations is permanently constructed on the drilling vessel. Offshore racking systems may weigh from 60,000 lbs to over 100,000 lbs and be capable of lifting 25,000 lbs. These systems are not practical for land drilling rigs.

Land rigs must be moved from one location to the next, every two or three weeks. Land drilling equipment is constructed to be readily rigged out, moved to the new location, and rigged up, quickly. A complete rig move may only take one to three days. What is missing in the prior art, and an object of the present invention to provide, is a relatively compact piece of equipment, with a total weight of less than 8,000 lbs, and capable of lifting 15,000 lbs; and which may be fitted onto both existing and new land drilling rigs. The present invention is also compact and robust. Whereas offshore systems are permanently installed and are capable of lifting only approximately one quarter of their own weight in tubulars, the present invention is portable and lifts nearly double its weight.

Also, it is an object of this invention to provide a smooth, controlled movement when moving the stands of drill pipe. When pipe stands are racked manually, there is considerable swinging of the bottom end of the stand when it is lifted with the drawworks. This swinging is slowed down by the rig floor personnel. This can put personnel at risk of injury. It is thus an object of the present invention to move stands in a controlled, smooth fashion, accelerating, moving, and decelerating to a stop with minimal swinging of the stand.

There are several devices and apparatus known in the art designed to improve the efficiency of the round trip operation. For example, U.S. Pat. No. 4,621,974 to Krueger, issued Nov. 11, 1986, provides an automated pipe equipment system for automatically removing pipe stands from, and adding pipe stands to, a drill string by using sensing means such as transducers to indicate to a programmable controller whether a pipe joint has been grasped by a racking arm. The Kruger system carries the stand of pipe in an assembly on the drill floor rather than lifting the stand. Furthermore, U.S. Pat. No. 4,117,941 to McCleskey Jr. et al., issued Oct. 3, 1978, provides a device which rapidly handles and vertically racks riser pipes and drill pipes in the drilling derrick. Manipulators effect the desired displacement of the pipes such that the lower ends of the pipes may rest on a set back platform on the drill floor and the upper ends of the pipes may be secured in a finger board. In addition, U.S. Pat. No. 4,013,178 to Brown et al., issued Mar. 22, 1977, provides a pipe racker wherein a maneuverable arm mounted on the derrick may grip the pipe joint anywhere along its length, lift the pipe, and move the pipe to another location without the need of a cable support. The vertical, horizontal and telescoping of the maneuverable arm provides the racker with three orthogonal degrees of freedom.

While the prior art provides devices for handling pipe stands in a more efficient manner, they do not provide a solution to address the instability associated with manipulating and transporting pipe stands that may exceed ninety feet in length and several thousand pounds in weight. Therefore, an unaddressed need exists in the industry to provide an apparatus for handling pipes in a stable and efficient manner to deal with deficiencies and inadequacies in the prior art.

In the prior art applicant is also aware of U.S. Pat. No. 6,821,071 which issued to Woolslayer et al. on Nov. 23, 2004, for an Automated Pipe Racking Process and Apparatus. Woolslayer describes a stand manipulator rather than a stand lifter automated pipe racking, wherein an arm support member is rotatable about an axis parallel to the well bore and wherein a gripper arm extends from the arm support member along an axis normal to the axis of rotation of the arm support member. A gripper head on the gripper arm extends from the gripper arm to grip the upper end of a pipe stand. The arm assembly is suspended from a carriage which moves along the underside of a working board mounted to a finger board or racking board. The working board extends between sets of fingers. Rotation of the arm and movement of the carriage permits movement of the upper end of a pipe stand from the well bore to the slots between the fingers. The lower end of each pipe stand is moved manually onto a base grid adding rows of multiple cells. When a pipe stand is on a cell it acts as a switch to send a control signal, upon which control signal the carriage, arm support member, gripper arm, and gripper head on the gripper arm engage the top of the pipe stand. A proximity sensor verifies that the pipe stand is in the gripper assembly. With the lower end of the pipe stand manually moved over one of the cells and the pipe stand than lowered onto that cell on the grid, the upper end of the pipe stand is than moved into a slot between the fingers of the racking assembly.

Thus Woolslayer teaches merely guiding the top of the pipe stand after the pipe has been lifted by the drilling rig elevators. In other words, the pipe stand itself is not lifted by the Woolslayer articulated arm. In the present invention, it is an object to provide an articulated assembly which lifts a complete pipe stand and is capable of lifting in the order of 12,000-15,000 pounds in contradistinction to the 1,000 lbs contemplated by Woolslayer, and once lifted carrying the completed pipe stand in a vertical position and inserting the pipe stand still in its vertical position into a desired slot between fingers of the racking board.

SUMMARY OF THE INVENTION

In accordance with the present invention, there is provided an apparatus for handling pipes in a drilling derrick wherein the apparatus stabilizes and supports the pipe stand such that unwanted movement of the pipe stand, which affects the rate of racking, may be reduced, thereby increasing racking efficiency In summary, the pipe stand racking system according to the present invention includes a racking board, an overhead frame for supporting the articulated arm mounted at the end of the diving board to the racking board, a rotation drive on the end of the driving board cantilevered in the open corridor between the fingers of the racking board, a parallelogram arm mounted to the rotation drive and a pipe stand gripper mounted to the arm. The overhead frame helps support the weight of the rotation drive, arm, gripper and any pipe stand being lifted. The arm is rotated and extended so as to position the gripper along linear paths corresponding to the open corridor and finger spacing's between the finger by coordination of rotation and extension of the arm as controlled by a controller. Pipe stands are thereby lifted and carried between well center and next available positions in the racking board.

The racking board has a pair of opposed facing arrays of the pipe stand supporting fingers mounted in a first frame. The opposed facing arrays of pipe stand supporting fingers define the open corridor therebetween. The corridor extends from a derrick-side opening in the first frame to an opposite backwall of the first frame opposite the derrick-side opening. The first frame is substantially horizontal when mounted to an open side of a derrick mast so as to register the corridor in cooperative alignment with the open side of the derrick mast. And wherein the first frame includes fasteners to mount a derrick-side of the first frame in the cooperative alignment with the open side of the derrick mast.

The overhead or second frame is mounted to the first frame so as to extend over the first frame when the first frame is mounted to the derrick mast. A tensile weight supporting member such as a rod is mounted to the second frame and extends downwardly from the second frame. A lower distal end of the rod is positioned over the corridor. The diving board or cantilevered member is mounted to the back wall of the first frame and extends therefrom cantilevered, in a plane containing the corridor, to a terminal end of the cantilevered member substantially coinciding with the lower distal end of the rod. A selectively controllable rotation drive is mounted to the terminal end of the cantilevered member and the lower distal end of the rod.

A parallelogram arm having a base end and an opposite pipe stand gripping end is mounted to the rotation drive. The parallelogram arm is mounted at the base end to the rotation drive for selectively positionable rotation of the parallelogram arm about an axis of rotation of the rotation drive. The parallelogram arm is selectively actuable between a retracted position adjacent the axis of rotation and an extended position extended therefrom. A pipe stand gripper is mounted at the pipe stand gripping end. The gripper is advantageously only a single gripping head gripping the pipe stand at only a single location along its length. The parallelogram arm maintains a pipe stand gripped in the gripper substantially vertical when the first frame is mounted to the derrick and the pipe stand is translated by the parallelogram arm between its extended and retracted positions.

When the first frame is mounted to the derrick mast, in its extended position the parallelogram arm has a reach sufficient to position the gripper at well center when the rotation drive is in a first rotational position. When the rotation drive is in a second rotational position the reach of the parallelogram arm is sufficient to place a pipe stand held in the gripper into a rear-most finger space between the back wall of the first frame and an adjacent finger of corresponding the array of pipe stand supporting fingers. When the parallelogram arm is in its retracted position, the gripper is rotatable by rotation of the parallelogram arm by the rotation drive along an arc having a retracted radius corresponding to rotation of the gripper and the parallelogram arm. The retracted radius allows rotation of the gripper about the axis of rotation within the corridor without interference with the ends of the fingers in the opposed facing arrays of pipe supporting fingers closest to the corridor. The gripper and the parallelogram arm are extendible between the retracted and extended positions when the rotation drive is in the first rotational position. The gripper and the parallelogram arm are rotatable by the rotation drive between the first and second rotational positions when the parallelogram arm is in the retracted position.

The spacing between the cantilevered member and the terminal ends of the fingers define at least one corridor space for passing there-along an end of a pipe stand held in the gripper. Each pipe stand may thus be moved back and forth from well center to the racking board. The weight of the pipe stand is transferred to front legs of the mast via the overhead second frame mounted above the racking board and through the racking board to the derrick mast so as to support the weight of the pipe stand from above whereby each full pipe stand may be lifted for positioning of the full stand.

A controller cooperates with the rotation drive and the parallelogram arm to control the position of the gripper. The controller controls the position of the gripper along optimized constrained and unconstrained paths. When following the constrained path the gripper, while carrying a pipe stand, follows a first linear path along a finger space adjacent a selected finger of the arrays of fingers, and follows a second linear path along the corridor space, on a side of the corridor between the cantilevered member and corresponding terminal ends of the fingers corresponding to the finger space. The gripper follows around the arc defined by the retracted radius, and from adjacent the rotation drive to a well-center position in the derrick when un-racking a pipe stand from the racking board, and vice-versa when racking a pipe stand from well-center to the racking board.

The gripper follows an unconstrained path only when not carrying a pipe stand. The unconstrained path follows an arcuate optimized path from the selected finger space to a ready position set back from the well center awaiting a next pipe stand running in or out of the well. Upon the arrival of the next pipe stand the gripper translates into a well center position closely adjacent the pipe stand.

The accelerations and decelerations of the gripper and the pipe stand being carried along the constrained path are optimized to minimize pipe stand instability, to smooth motion of the pipe stand along the constrained path, and to minimize probability of impact of a pipe stand held by the gripper with the racking board during translation along the constrained path. In order to accomplish this rotational and extension motions of the arm are coordinated together to create straight line movement of the gripper and a pipe stand held therein along the first and second linear paths.

In a preferred embodiment the gripper includes a selectively vertically movable portion selectively vertically movable relative to the parallelogram arm. A gripping head is mounted on the vertically movable portion. A pipe stand is gripped in the gripping head and is selectively vertically translatable independently of movement of the parallelogram arm. The vertically movable portion may include a selectively actuable telescopic portion for vertical telescopic translation of the gripping head.

A controller cooperates with the rotation drive and the parallelogram arm for positioning the gripper along the constrained and unconstrained paths. The controller is adapted to catalogue the quantity of, and to store the position of each pipe stand stored in the racking board. The controller may thus position a subsequently retrieved pipe stand in an unoccupied storage position adjacent occupied storage positions and retrieve next available pipe stands from occupied storage positions without interference with other pipe stands stored in the racking board. The controller may also cooperate with the vertically movable portion to elevate or lower a pipe stand held in the gripping head at well center prior to or subsequent to translation of the gripping head along the constrained path respectively.

In one embodiment the overhead second frame extends substantially orthogonally from the first frame. The rod may be a rigid substantially linear member depending downwardly from a vertex position of the second frame substantially centered over the first frame. The rod may be parallel to the axis of rotation of the rotation drive. The second frame may include an inverted u-shaped frame member and the rod may depend vertically downwards from the vertex position centered along the u-shaped frame member to support the rotation drive at least vertically. A tension member may be mounted at a lower end thereof to a rear side of the first frame. An upper end of the tension member is mountable to an upper position of the derrick mast above where the racking board is mounted to the derrick mast. The tension member supports the rear side of the first frame and reduces a moment loading on the fasteners of the first frame where mounted to the derrick mast on a front side of the racking board. The tension member may include a pair of tension members such as spaced apart struts or cables on opposite ends of the rear side of the first frame. The tension members may thus be linear and the fasteners may be mounting brackets which include reinforcing plates mounted to the derrick mast. Opposed facing leg portions of a front wall of the first frame, opposite the back wall, may be mounted to the reinforcing plates so as to abut the leg portions against the reinforcing plates.

BRIEF DESCRIPTION OF THE DRAWINGS

These and other features of the invention will become more apparent from the following description in which reference is made to the appended drawings wherein:

FIG. 2*b* is a partially cut-away enlarged view of a portion of FIG. 2*a*.

FIG. 3*b* is, in partially cut-away side elevation view, the manipulating arm and gripping head of FIG. 3*a* shown with the gripping head in its elevated position and gripping a pipe stand.

DETAILED DESCRIPTION OF EMBODIMENTS OF THE INVENTION

Figure 1:
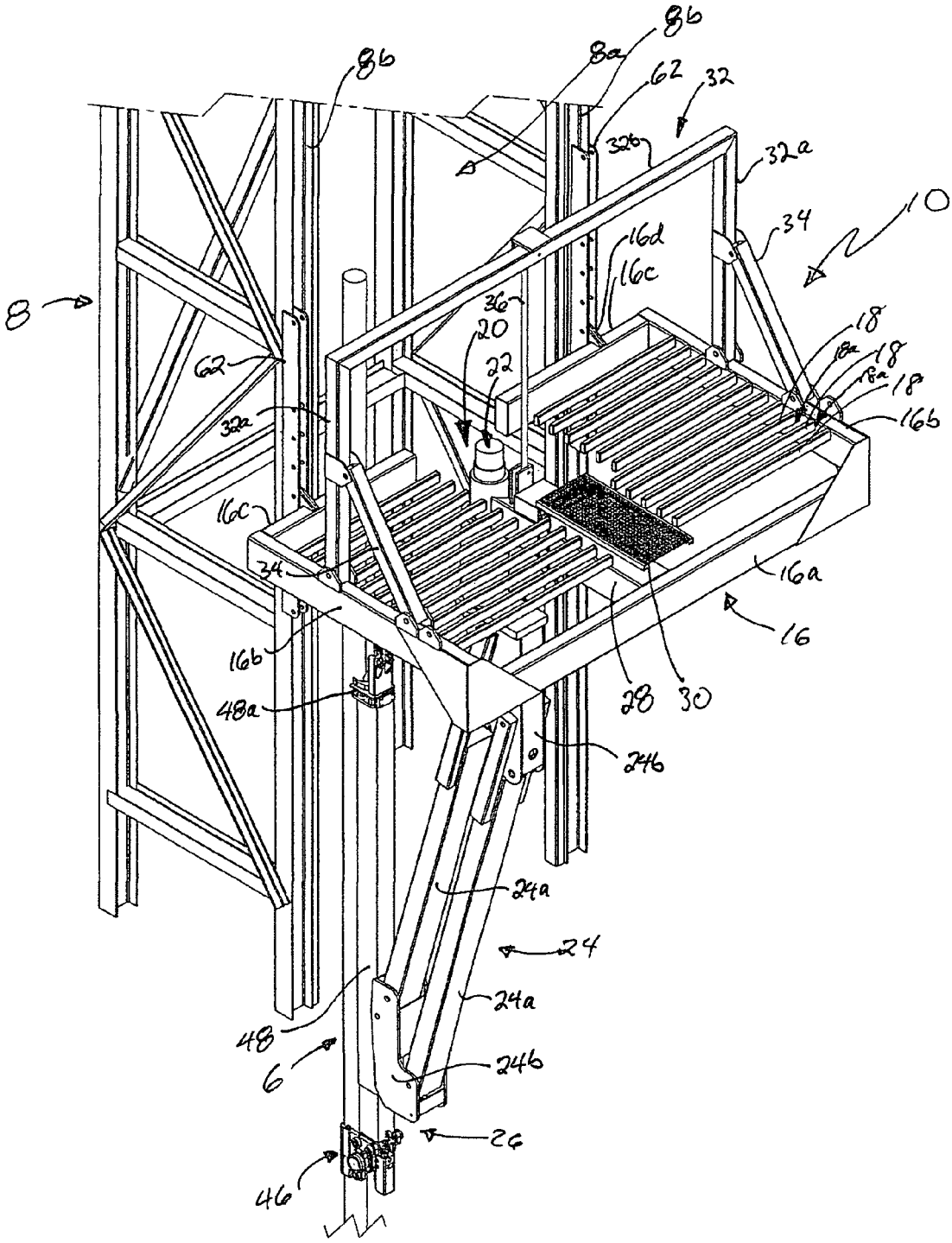
FIG. 1 is, in top perspective view, the apparatus for handling and racking pipes according to the present invention mounted to the open front face of a derrick mast, with the pipe gripping head of the manipulator arm at the well center position.
Figure 1A:
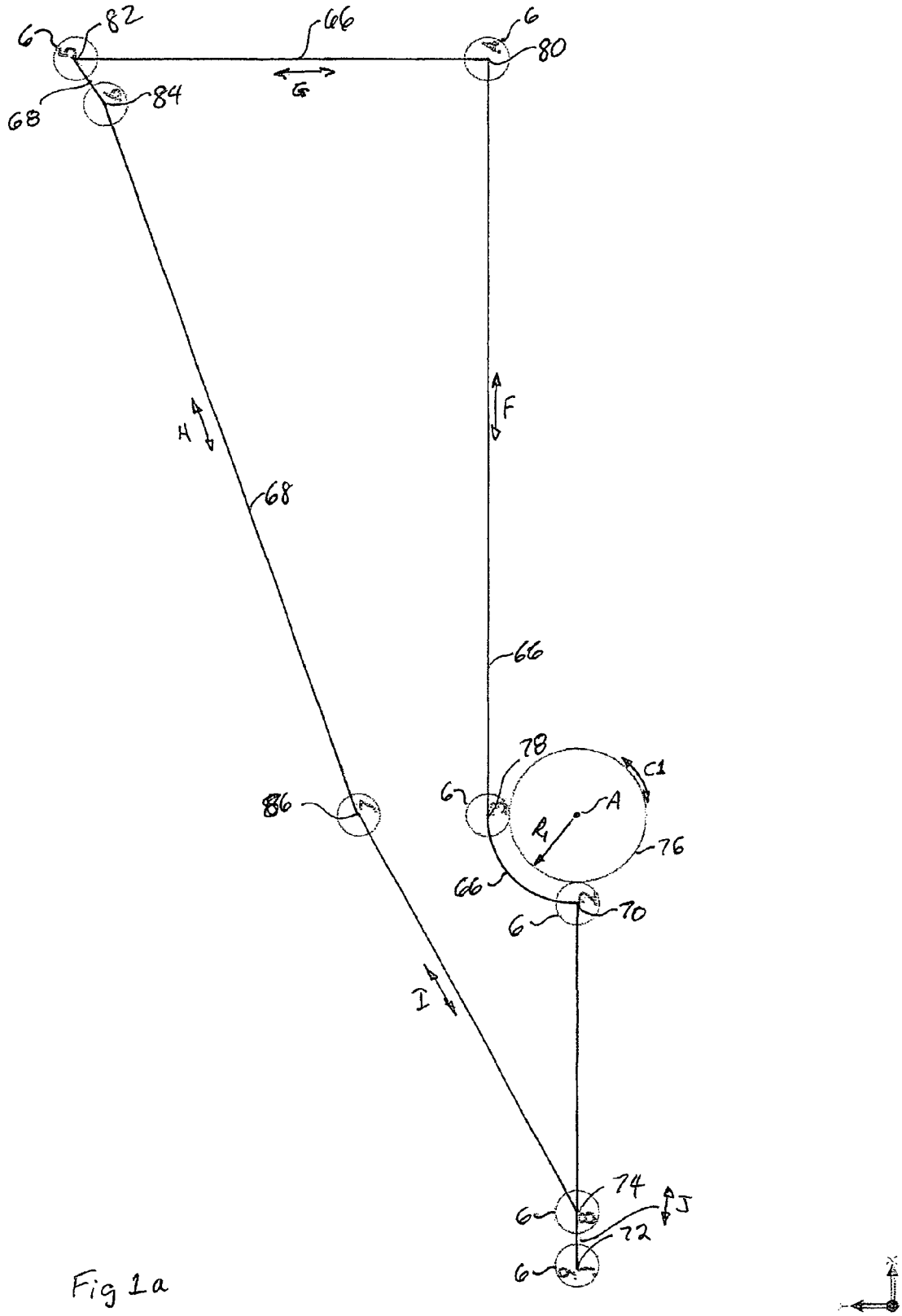
FIG. 1*a* is, in plan view, a diagrammatic representation of the constrained and unconstrained trajectories of the gripping head on the manipulating arm between well center and a pipe stand storage position in the racking board.

With reference to the Figures wherein similar characters of reference denote corresponding parts in each view, the apparatus for handling pipe stands 6 includes a derrick 8, a pipe racking assembly 10 mounted to derrick 8. A rotatable and articulated assembly 20 is mounted to pipe racking assembly 10 in a central open corridor 12. In an embodiment of the present invention, the apparatus for handling pipes is configured to handle and rack a plurality of pipe stands 6 which are triple stands or larger. In use the pipe stands are detachably coupled together to form a drill string 14.

In an embodiment of the invention, pipe racking assembly 10 is generally rectangular in shape and horizontally disposed. Pipe racking assembly 10 is mounted to a mid-portion of derrick 8 such that pipe racking assembly 10 extends outwards and away from derrick 8. Pipe racking assembly 10 includes a first frame 16 and a plurality of transversely disposed support members such as fingers 18 mounted to frame 16 such that each finger 18 attaches to frame 16 at a first end only. Fingers 18 are arranged in an opposed facing pair of planar arrays of parallel spaced apart fingers 18 having slots 18*a* therebetween. In an embodiment of the invention, rotatable assembly 20 is mounted to frame 16 such that rotatable assembly is positioned in gap 17 so that pipe stand 6 may travel along corridor 12 towards support members 18. To rack pipe stand 6, pipe stand 6 is positioned in slots 18*a* between support members 18 and pipe stand 6 is lowered to stand against the fingers 18 and to rest the base of the pipe stand on the rig floor set back area.

The rotatable and articulated assembly 20 includes a rotation drive 22 supporting and selectively rotating about axis of rotation A a parallelogram arm 24 having a pipe stand gripper assembly 26 mounted at the distal end thereof. Rotation drive 22 is rigidly mounted to a rigid cantilevered member 28 which extends perpendicularly from a back wall 16*a* at the rear most side of first frame 16.

The opposed facing arrays of parallel co-planar fingers 18 are mounted to the parallel pair walls 16*b* which rigidly join the back wall 16*a* to the opposed facing co-linear legs 16*c* of the front wall of frame 16 on the derrick-side of the racking board. The opposed facing free ends of legs 16*c* and the inwardly disposed free ends of fingers 18, are inwardly disposed into frame 16, and are spaced apart to form the open corridor 12 which substantially bisects through the racking board between the derrick-side of frame 16 and the back wall of frame 16.

Figure 7:
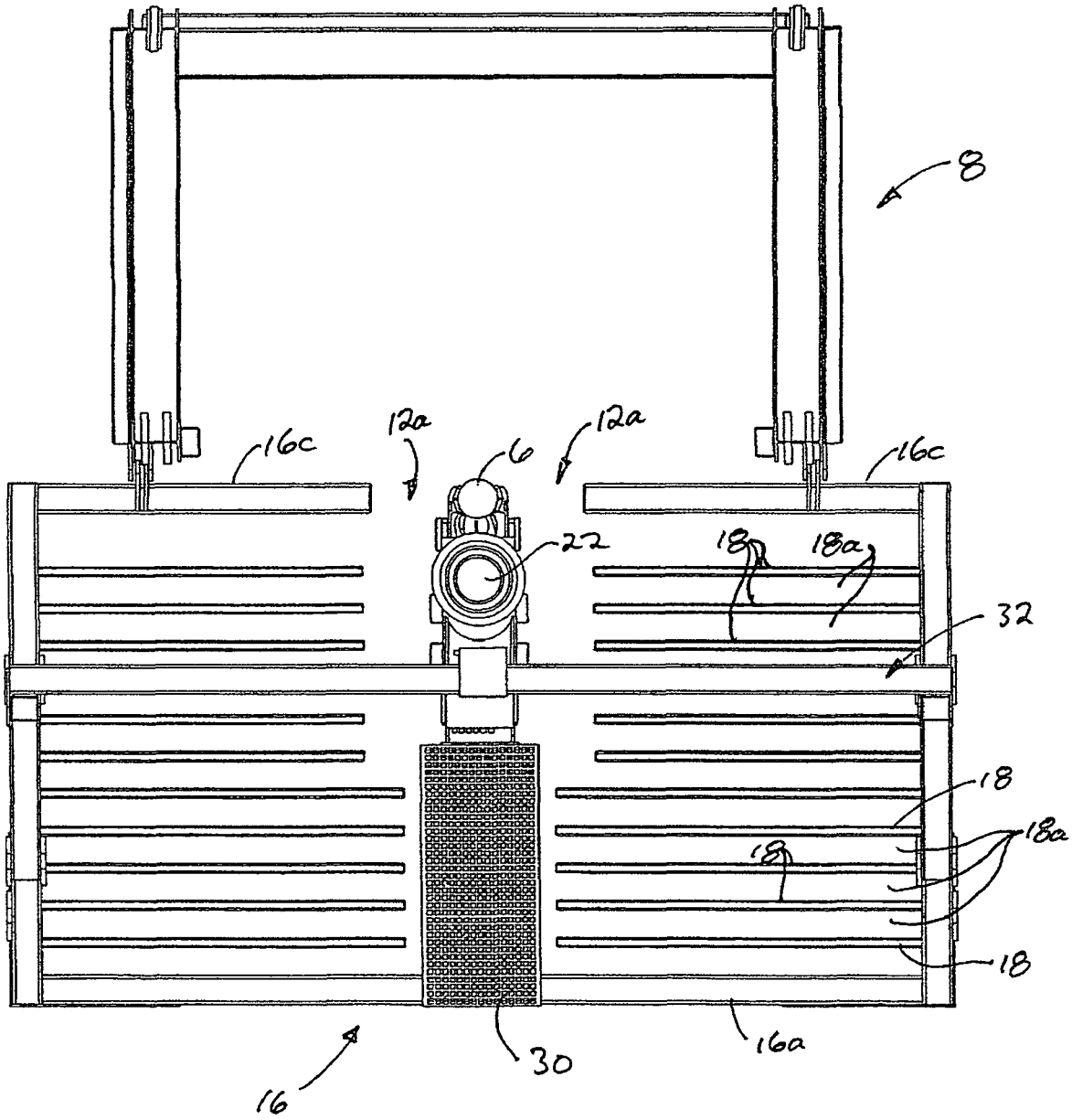
FIG. 7 is, in plan view, the apparatus of FIG. 4.
Figure 8:
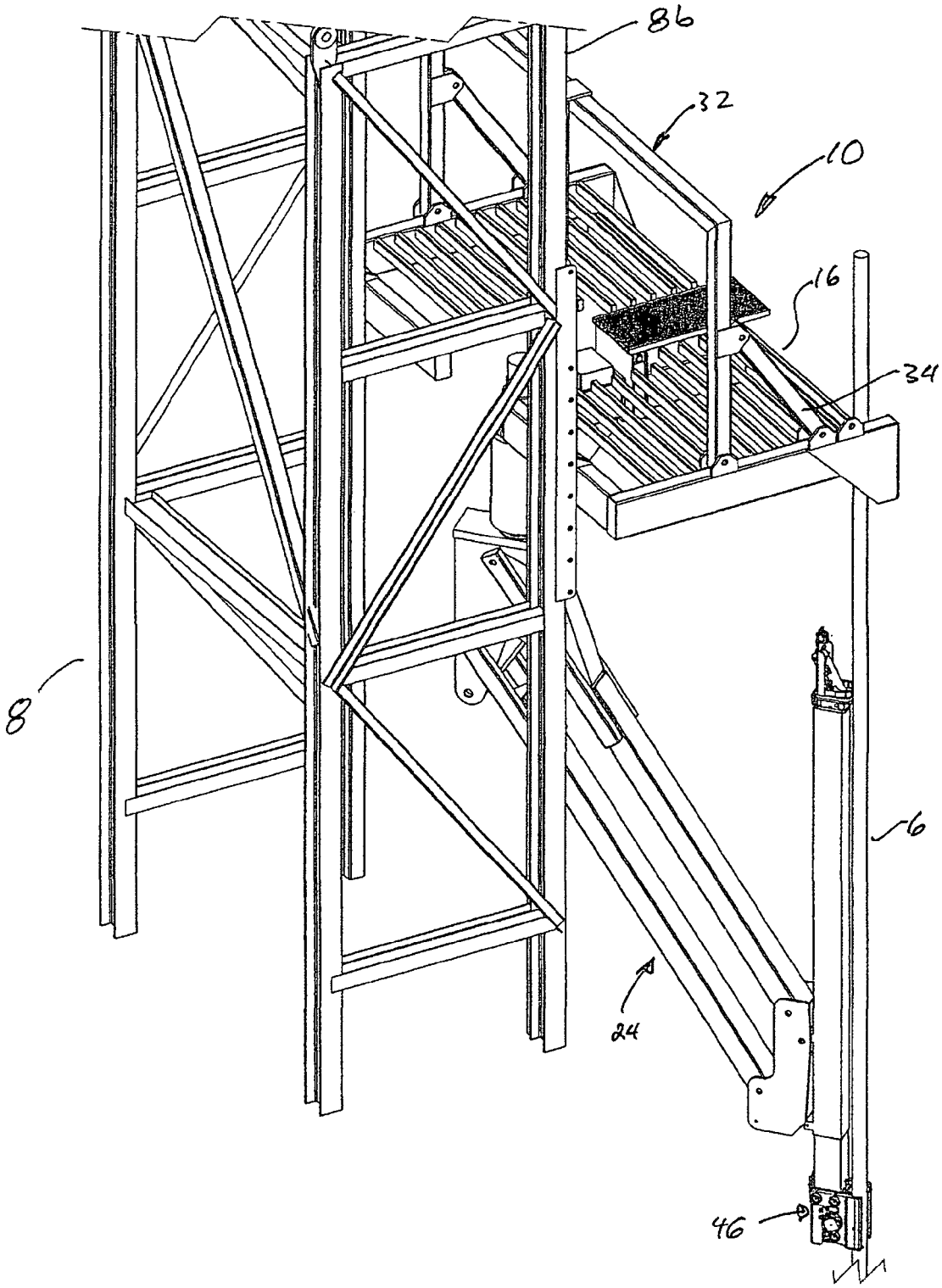
FIG. 8 is the perspective view of FIG. 4 with the manipulating arm and gripping head having been rotated and extended so as to traverse the pipe stand held in the gripping head along the open corridor between the rotation drive and the fingers on the right hand side of the racking board so as to rack the pipe stand into the furthest back corner of the racking board.
Figure 22A:
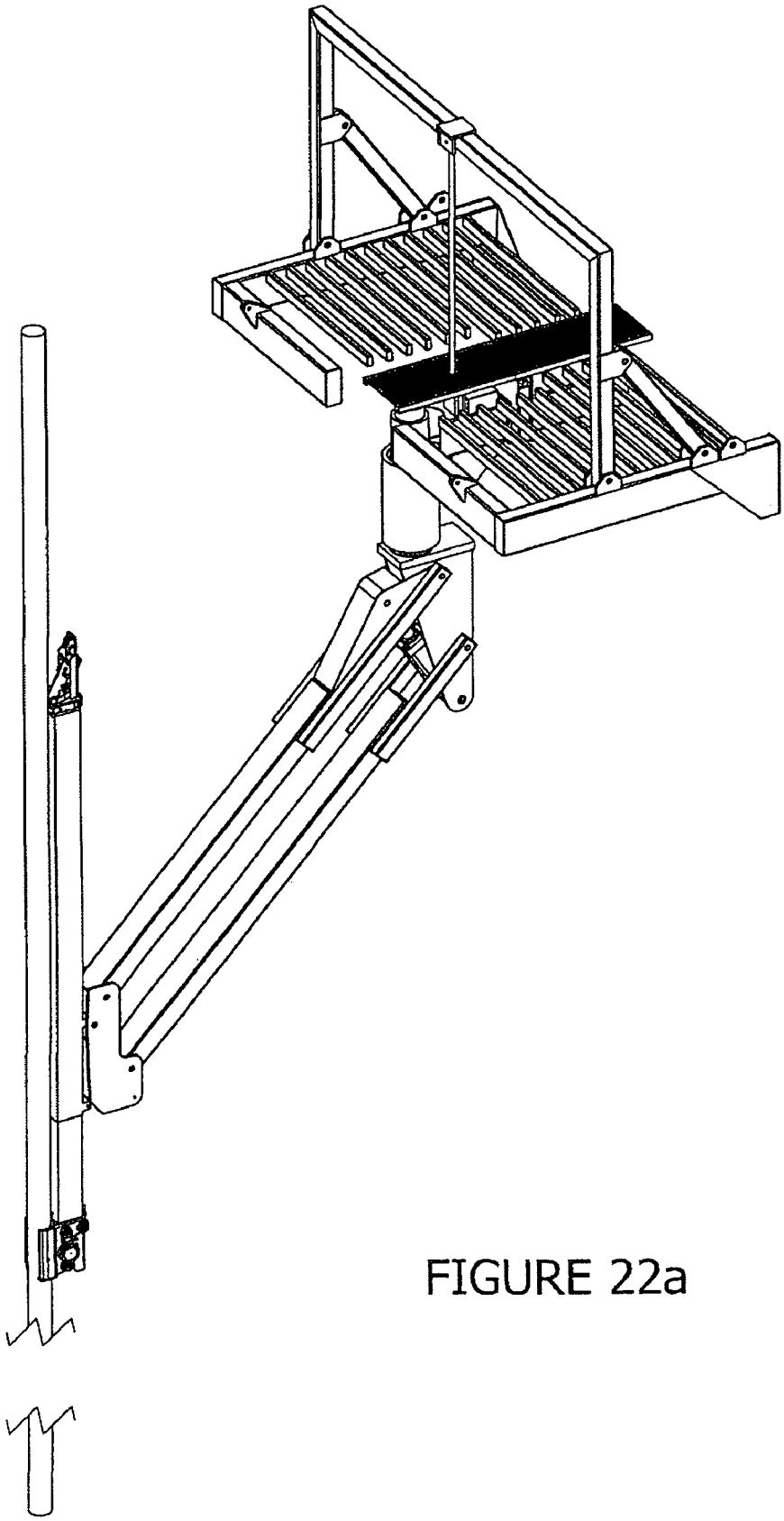
FIG. 22*a* is, in derrick-side top perspective view, an alternative embodiment of the apparatus according to the present invention.
Figure 22B:
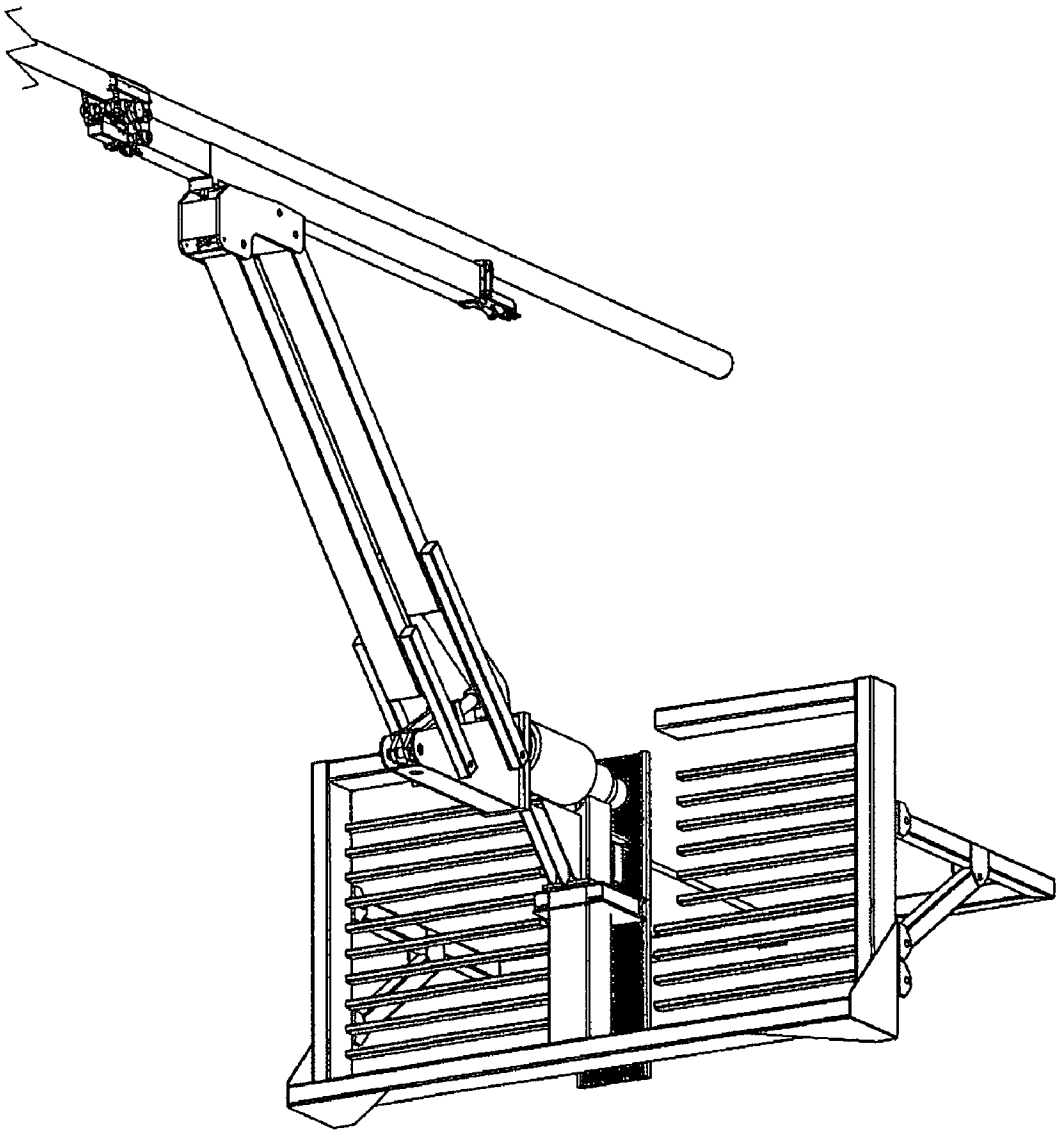
FIG. 22*b* is, in bottom perspective view, the apparatus of FIG. 22*a*.
Figure 22C:
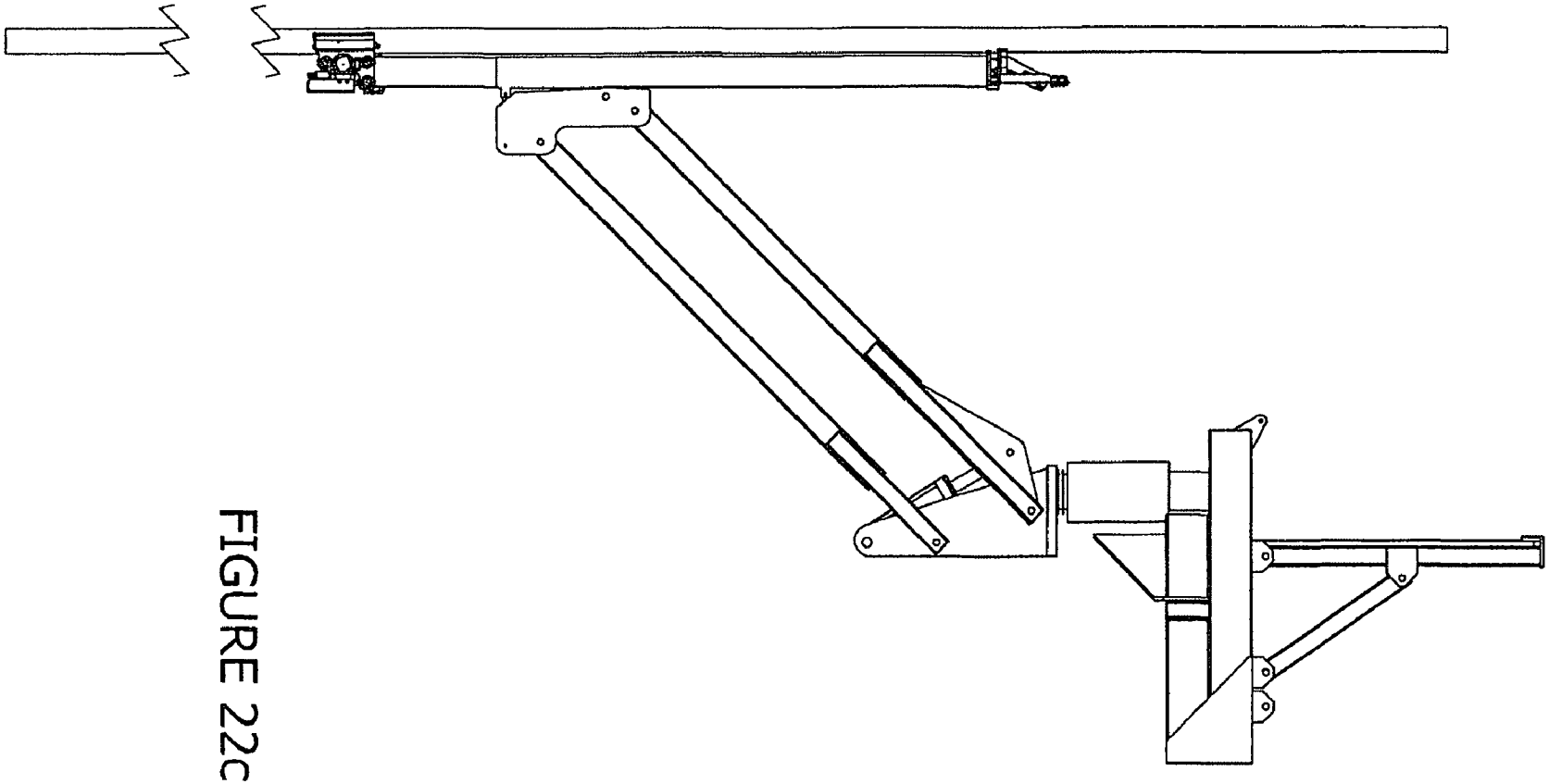
FIG. 22*c* is, in side elevation view, the apparatus of FIG. 22*a*.

Cantilevered member 28, referred to in the art as a diving board, extends along corridor 12 along the plane B of the corridor. In one embodiment, which is not intended to be limiting, member 28 is parallel with and lies below a plane containing fingers 18. In a preferred embodiment, a walking platform or grid 30 is mounted onto member 28 so as to provide a walking surface substantially in the plane containing fingers 18 for use in the event that manual racking of a pipe stand is desired, it being important to note that member 28 and assembly 20 including rotation drive 22, parallelogram arm 24 and gripper assembly 26, when the latter two components are in their home position as seen in FIGS. 7 and 8, do not interfere with free access to and along the parallel aisles 12*a* of corridor 12 formed on either side of member 28 between member 28 and the distal ends of fingers 18. In the embodiment of FIG. 22*a*-22*c* the walking platform or diving board extends completely over drive 22 which is advantageous for manual racking. Arm 36 extends downwardly through the platform.

A second frame 32 is rigidly mounted to so as to extend over first frame 16. In one embodiment which is not intended to be limiting, second frame 32 is in the shape of an inverted "u".

The vertical legs 32*a* and the horizontal cross member 32*b* collectively form second frame 32. Legs 32*a* are braced by a corresponding pair of brace members 34 extending between a midpoint of legs 32*a* and members 16*b* of frame 16. Vertical arm 36 is mounted at its upper end to a midpoint along cross member 32*b* and at its lower end to the distal end of member 28 adjacent rotation drive 22. Vertical arm 36 supports in tension, and in combination with cantilevered member 28, downward loads on rotation drive 22 due to the weight and accelerations imparted to a pipe stand 6 held in gripping assembly 26, and dynamic loads associated therewith. Such loads for example caused by linear and rotational translation of the gripping assembly 26 during actuations of parallelogram arms 24 and rotation drive 22 as transmitted to rotation drive 22 via parallel arms 24*a* of the parallelogram arms, and the corresponding end brackets 24*b* pinned on opposite ends of arms 24*a* and rotation shaft 38 rigidly connecting the upper of brackets 24*b* to rotation drive 22. As referred herein, although in the illustrated embodiment vertical arm 36 is mounted to rotation drive by a rigid mounting of the lower end of arm 36 to the distal end of member 28 adjacent to rotation drive 22, it is understood that is not intended to be limiting and is collectively referred to herein as being mounted to rotation drive 22. One skilled in the art would understand that the lower end of arm 36 could be mounted in the vicinity of rotation drive 22 so as to support the downward and dynamic loading on rotation drive 22 in a number of ways whether the lower end of arm 36 is mounted directly to rotation drive 22 or in the close vicinity thereof via a common segment of rigid supporting structure. Thus as used herein when it is referred to the lower end of arm 36 being mounted to rotation drive 22, it is collectively intended to encompass the mounting of the lower end of arm 36 either directly to or in adjacency to rotation drive 22.

Rotation drive 22 is controlled by a controller (not shown) so as to selectively rotate shaft 38 within cylindrical collar 40 and corresponding bearings 42 so as to thereby selectively rotate parallelogram arm 24 about axis of rotation A. Independently of rotation of shaft 38 by rotation drive 22, parallelogram arm 24 may be actuated by actuator 44 to selectively elevate or lower arms 24*a* in direction C so as to thereby correspondingly elevate or lower a pipe stand 6 held in gripping assembly 26 while maintaining pipe stand 6 in a vertical orientation and are assisted by a pipe stand supporting collar 48*a* mounted at the upper end of vertical support 48.

Gripping assembly 26 includes gripping head 46 mounted at the lower end of a telescopically actuated vertical support 48 which telescopically actuates in direction D by the extension and retraction of actuator 50 mounted within the outer housing of vertical support 48. The extent by which gripping head 46 may be extended downwardly in direction D from vertical support 48 depends on the length of the stroke of actuator 50 housed within the housing of vertical support 48. Thus to remove a pipe stand 6 from well center within derrick 8, once the pipe stand has been decoupled from the drill string, and with actuator 50 extended so as to position gripping head 46 in a lowered position, parallelogram arms 24 are rotated upwardly towards well center from their home position retracted under rotation drive 22 and aligned towards well center, so as to bring vertical support 48 alongside and aligned with pipe stand 6 where it is held in its hoist or top drive.

Gripping head 46 is thereby brought into mating engagement with pipe stand 6 and in particular so as to position pipe stand 6 between the parallel clamping arms 52 of the gripping head. An actuator within gripping head 46 such as the illustrated threaded actuator 54 translates in direction E the clamping arms 52 either away from each other or towards each other while maintaining their parallel relationship by arms 52 sliding on parallel alignment shafts 56. In the case of engaging with the pipe stand 6 at well center so as to remove the pipe stand to the racking board for storage, once gripping head 46 is mated against pipe stand 6 so as to engage the clamping surfaces 52*a* against the outer surface of the pipe stand by the actuations of actuator 54. Toothed splines 58 located on the interior of each gripping or clamping surface 52*a* are thereby clamped into frictional engagement rigidly against the outer surface of the pipe stand. Clamping pipe stand 6 within the elongate gripping and clamping surfaces 52*a* of clamping arms 52 allows pipe stand 6 to be maintained in its vertical orientation during translation of the pipe stand to and from the racking board. Gripping head 46 is mounted to the lower most end of actuator 50 by means of mounting brackets 60. Where actuator 54 is a threaded actuator as illustrated, a hydraulic motor 54*b* may be provided to rotate the shaft 54*a* of the actuator which is threadably journalled within corresponding threaded bores 52*b* in each of clamping arms 52 on oppositely disposed ends of threaded shaft 54*a*. Legs 16*c* of first frame 16 may be mounted to the open side 8*a* of derrick 8 by pinned mounting of flanges 16*d* rigidly mounted to legs 16*c* with elongate channel brackets 62 mounted to the corresponding vertical supports 8*b* on the open side 8*a* of derrick 8.

When first frame 16 is mounted to derrick 8 by the pinned engagement of brackets 16*d* with the corresponding apertures along channel brackets 62, the front face of legs 16*c* bear against the corresponding edges of channel brackets 62. However this engagement of first frame 16 against the channel brackets is not intended to bear the pivoting moment about the pinned connection of brackets 16*d* as a result of the weight load acting downwardly through rotation drive 22 and communicated to first frame 16 via cantilevered member 28, and also due to the rest of the weight of the racking board assembly. Rather, struts or other tension supports 64 are mounted at their lower most ends to the rear of first frame 16 for example to the rear end of members 16*b* as illustrated, and are mounted at their upper most ends to mast 8 and in particular to mast members 8*b* at mounting points well above first frame 16.

Figure 11:
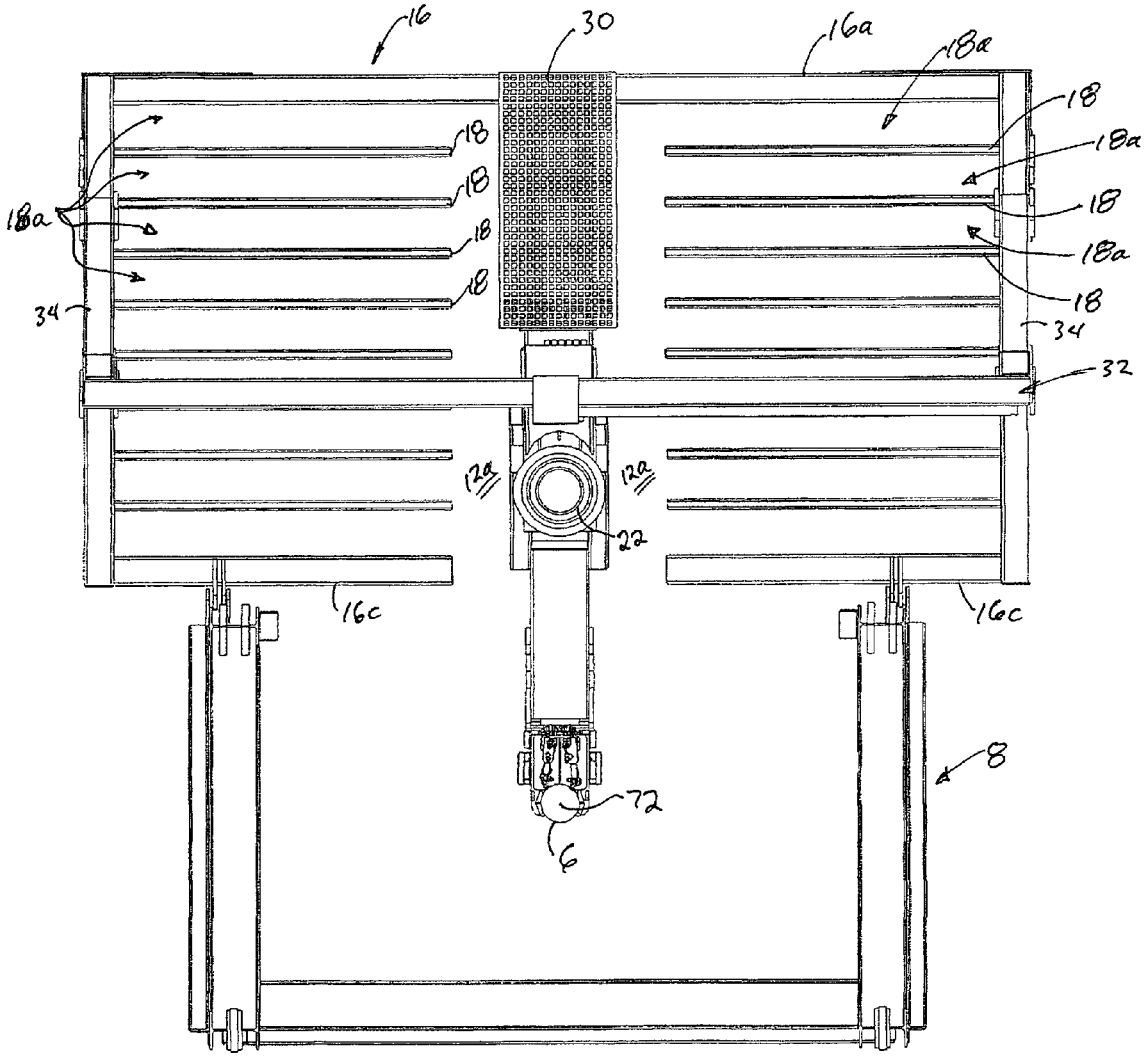
FIG. 11 is, in plan view, the apparatus of FIG. 2 with the gripping head in the well center position.
Figure 12:
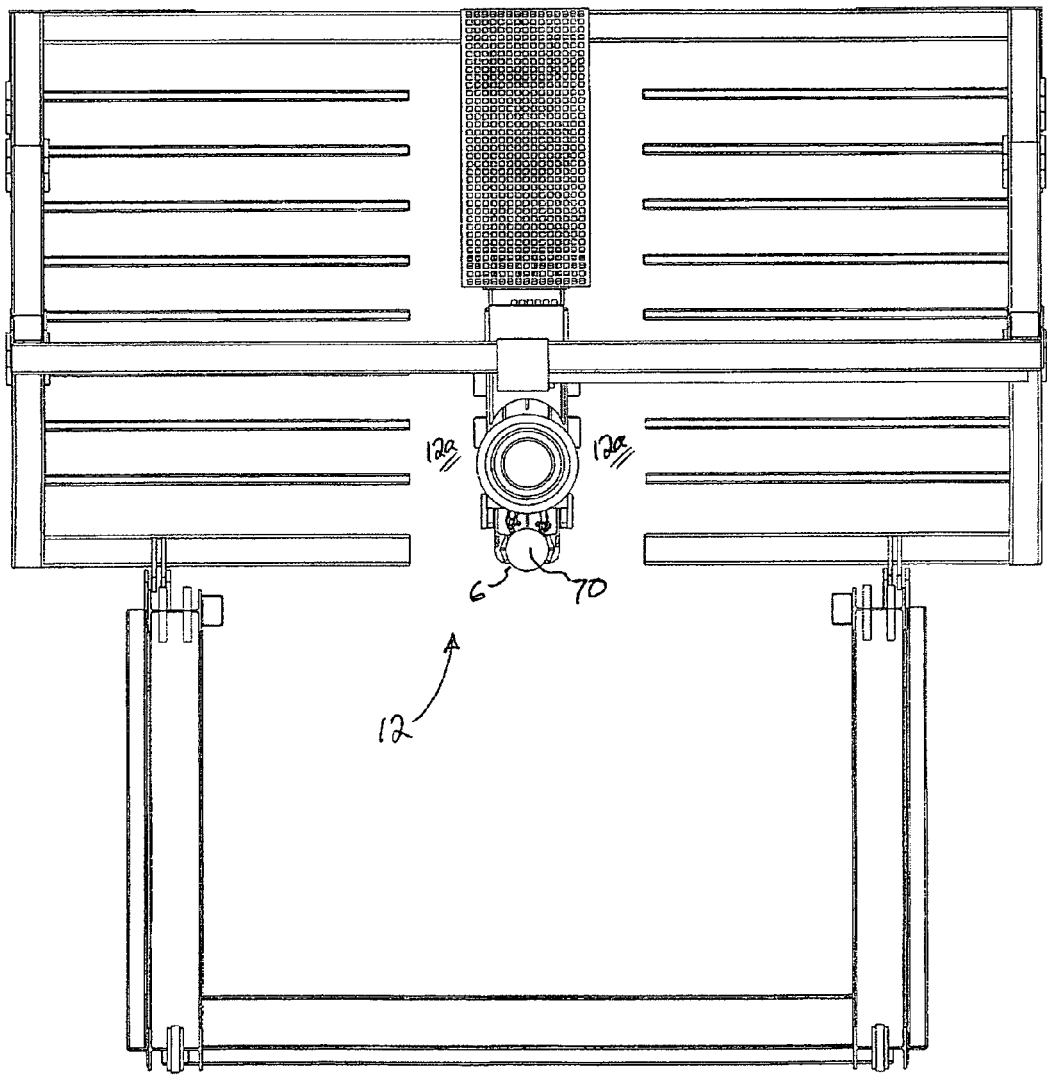
FIG. 12 is the view of FIG. 11 with the gripping head in the home position.
Figure 13:
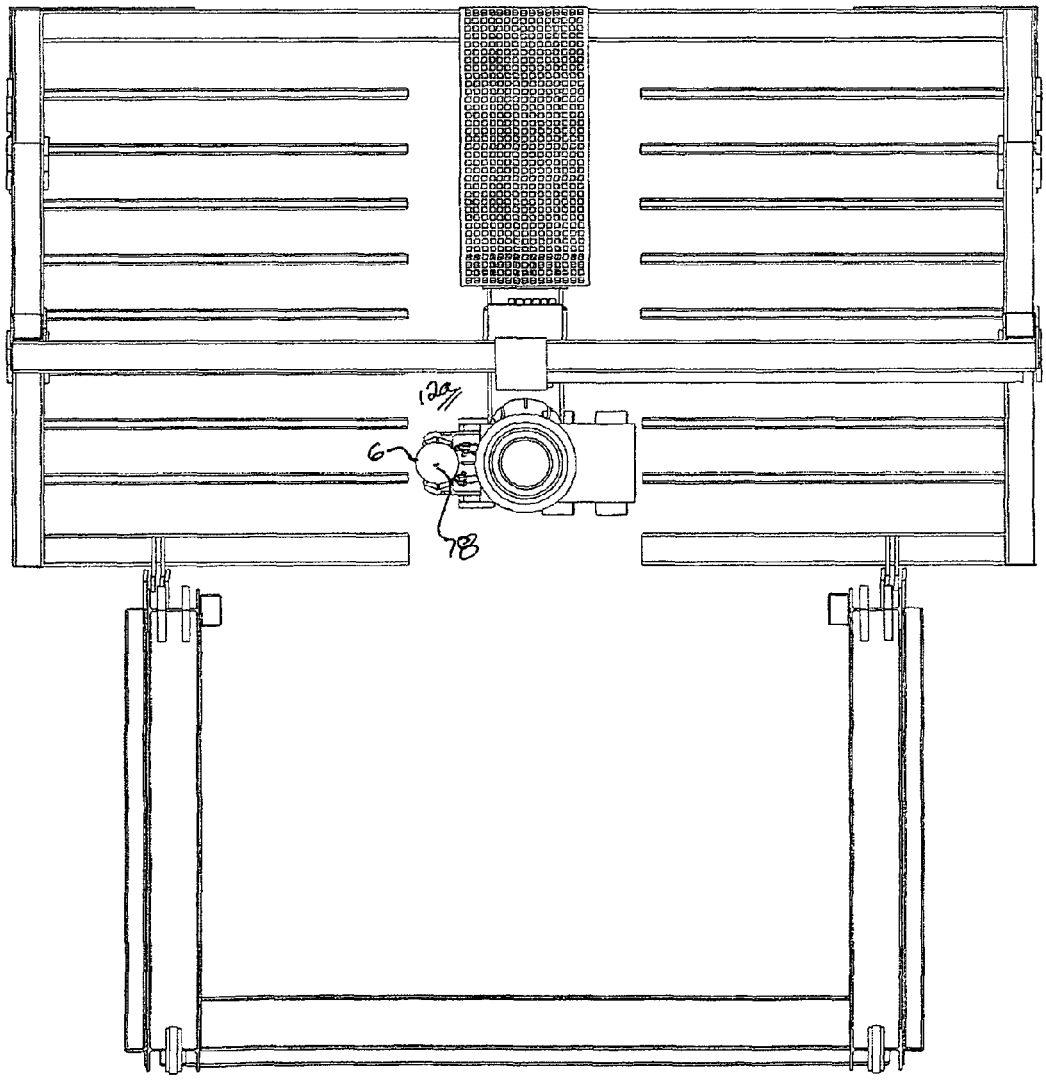
FIG. 13 is the view of FIG. 12 with the gripping head in the 90 degree rotated position relative to the home position.
Figure 14:
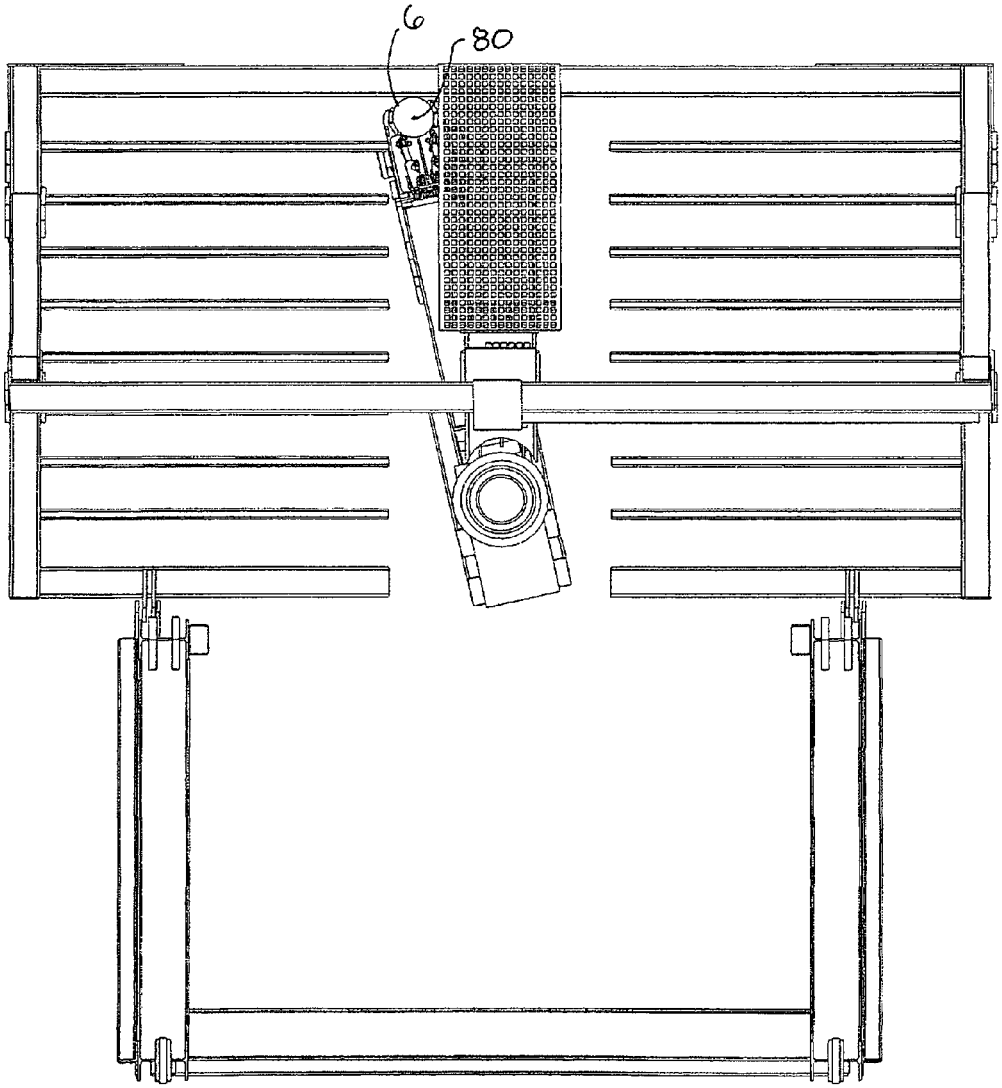
FIG. 14 is the view of FIG. 13 with the gripping head in the finger space aligned position.
Figure 15:
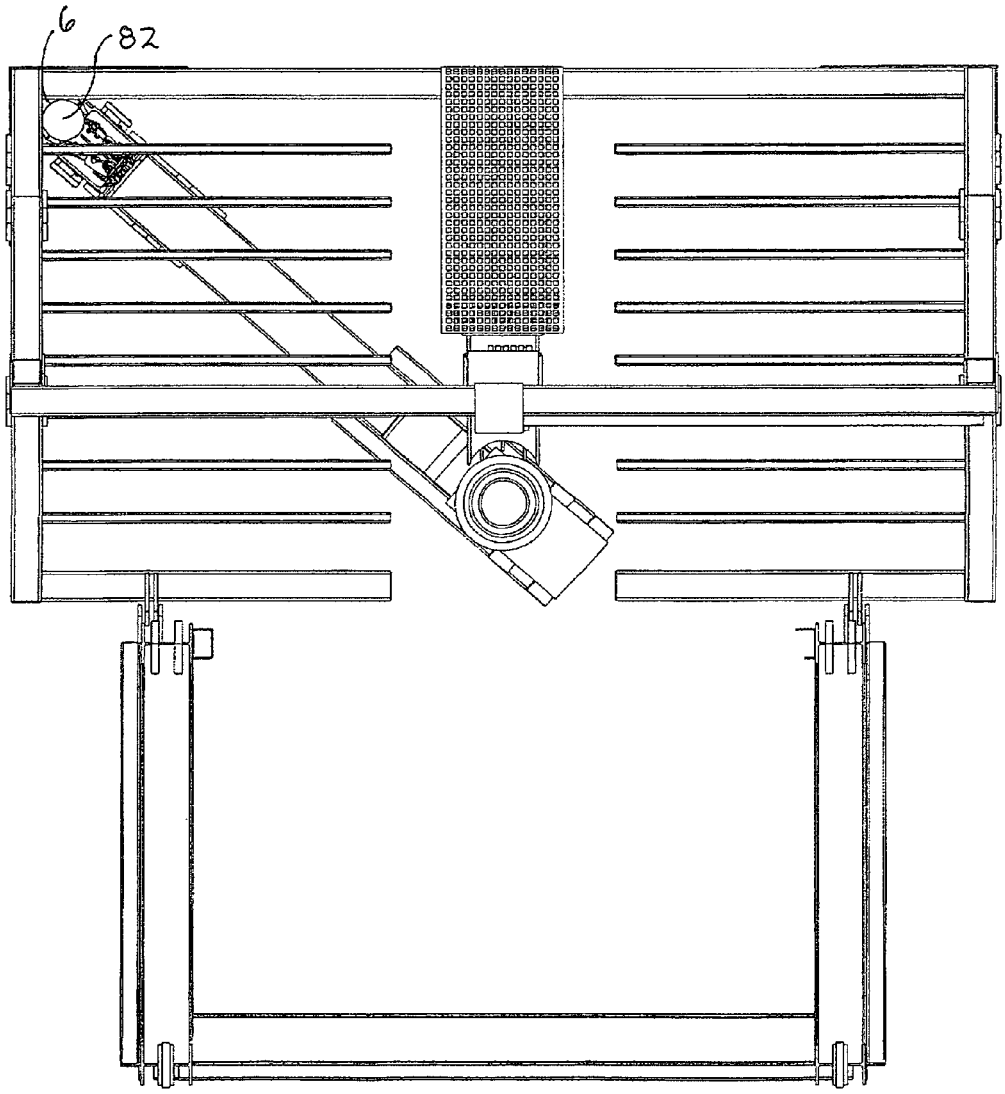
FIG. 15 is the view of FIG. 14 with the gripping head in the next most available position in the racking board, which as illustrated is the far back corner on the left hand of the racking board.
Figure 16:
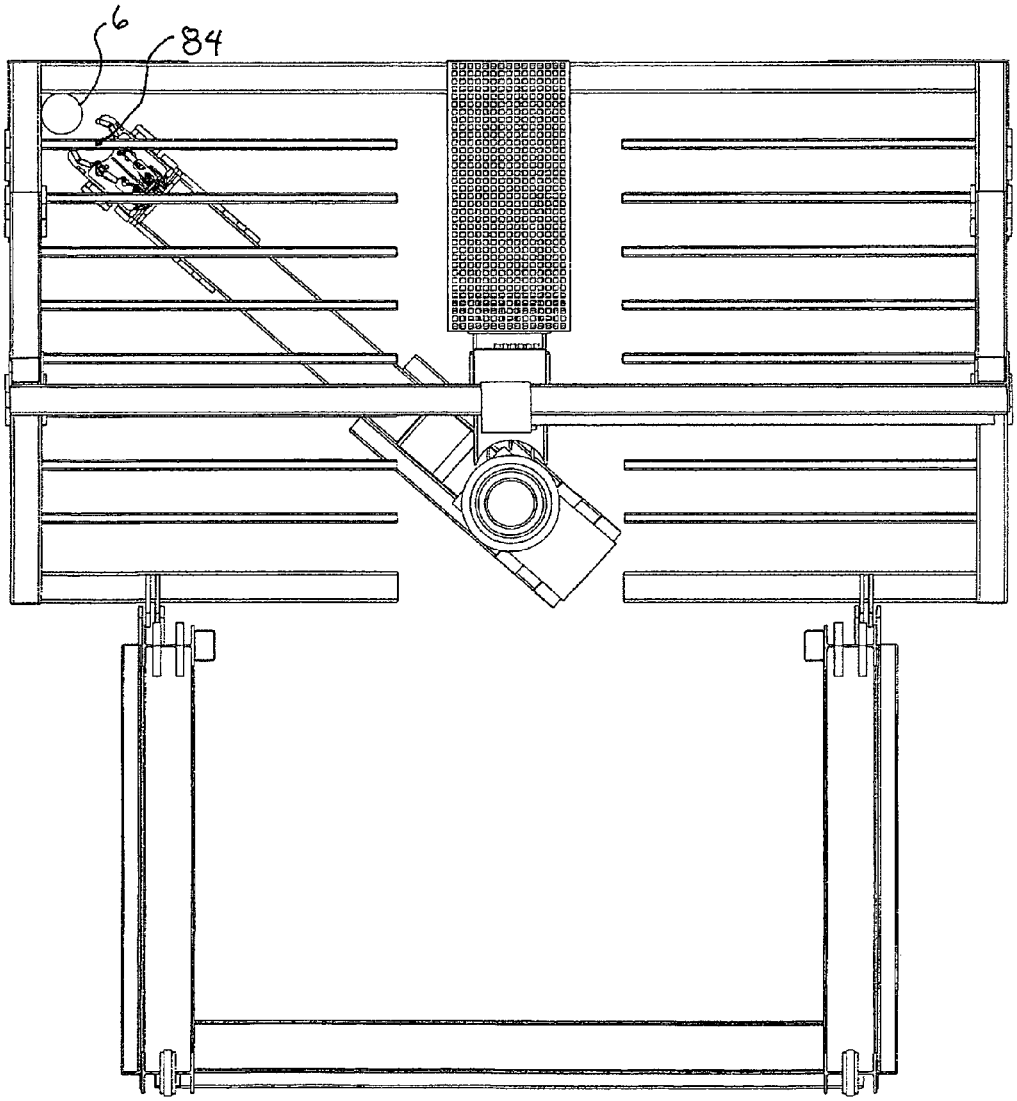
FIG. 16 is the view of FIG. 15 with the gripping head just released from the pipe stand in its storage position.
Figure 17:
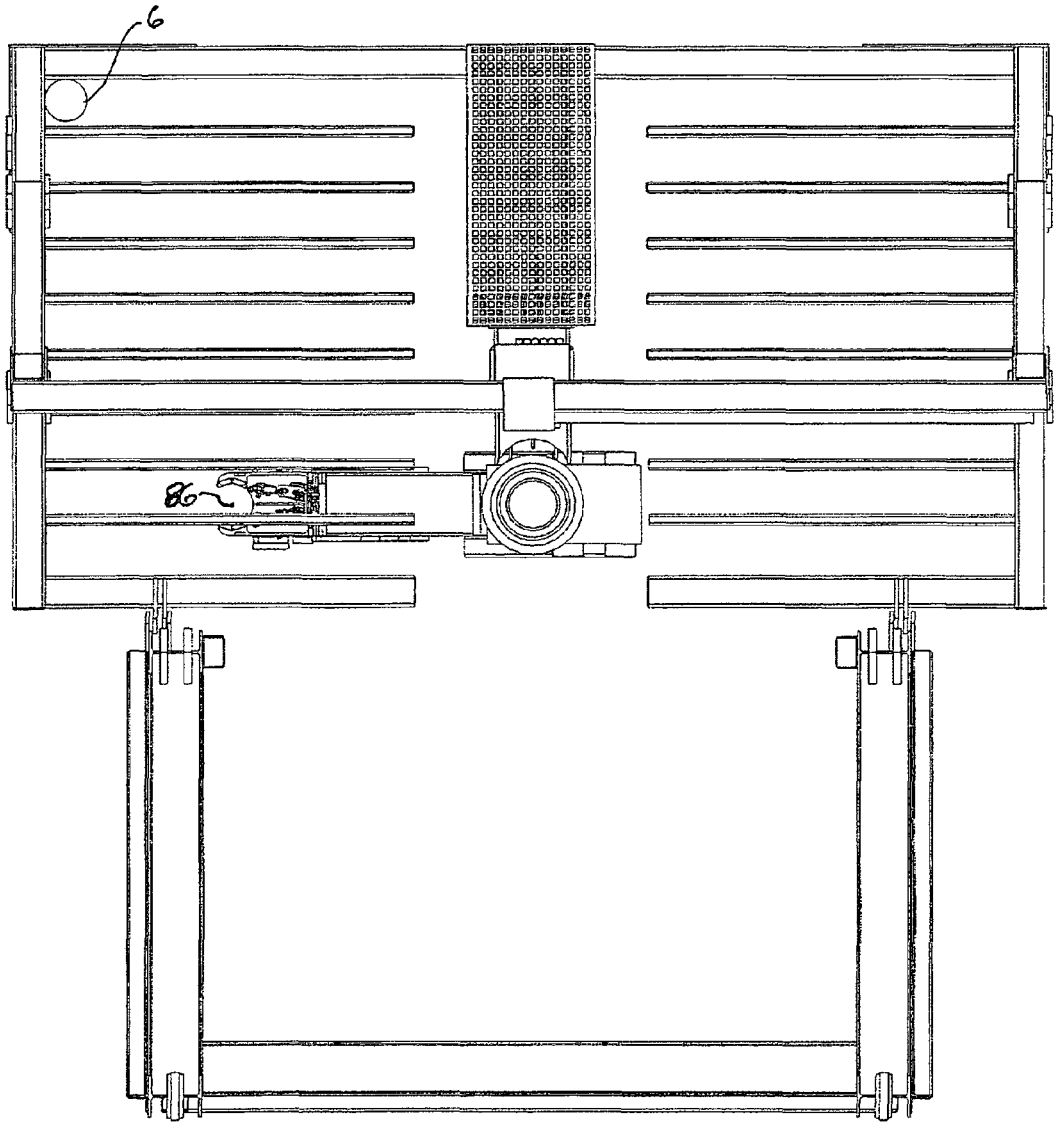
FIG. 17 is the view of FIG. 16 with the gripping head in a further intermediate position orientated 90 degrees from the home position.
Figure 18:
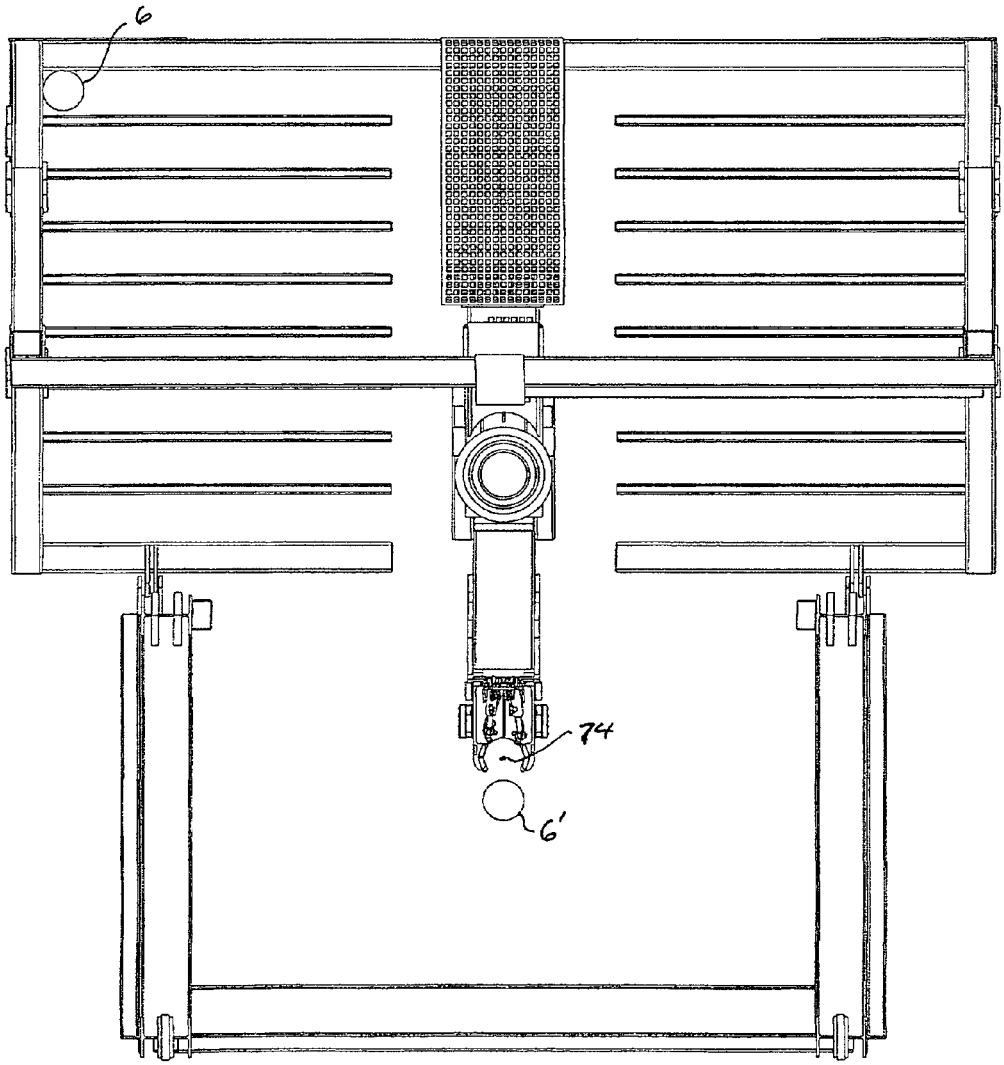
FIG. 18 is the view of FIG. 17 with the gripping head adjacent the well center position.
Figure 19:
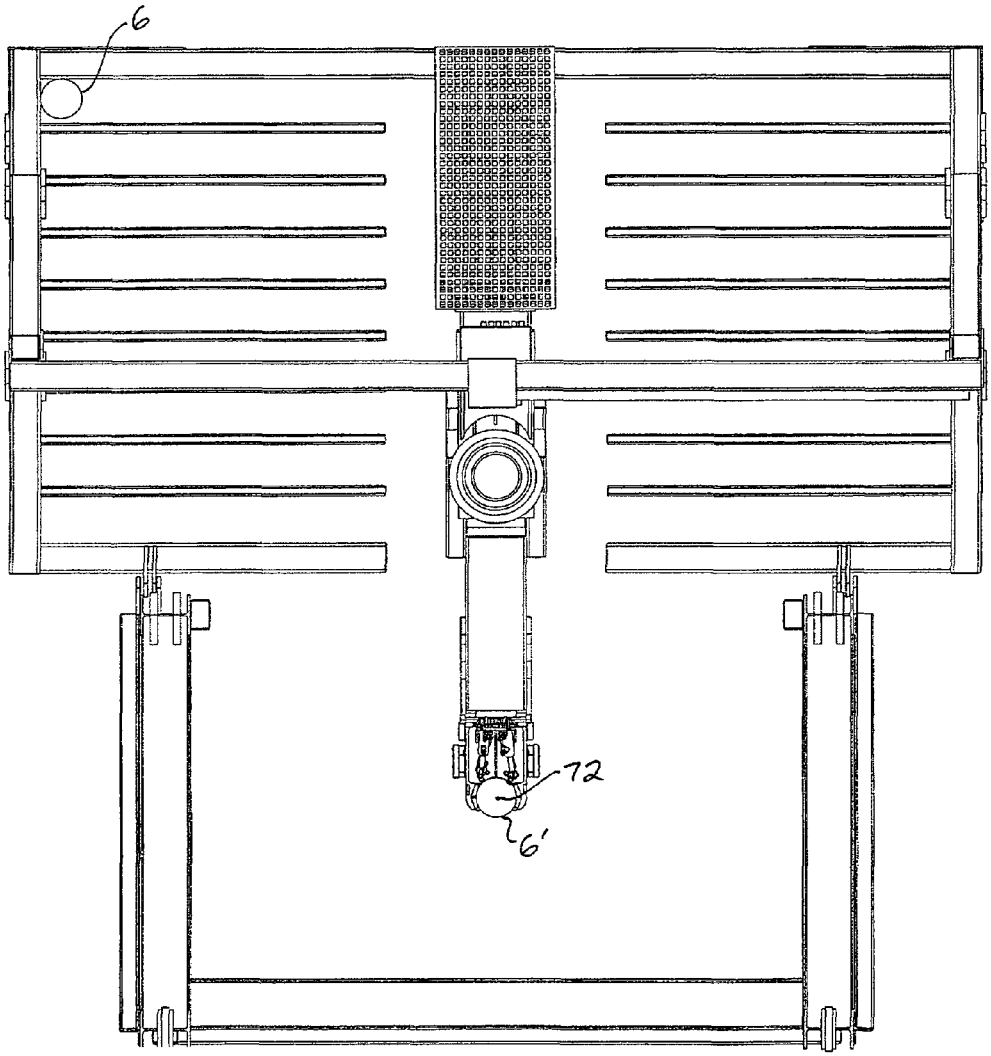
FIG. 19 is the view of FIG. 18 with the gripping head returned to the well center position.

As described above, rotatable and articulating assembly 20 has a home position when parallelogram arms 24 are tucked flush under rotation drive 22 with gripper assembly 26 aligned towards well center. In the two dimensional plot of FIG. 11, the constrained path 66 of the translation of gripping assembly 46 and in particular the translation of tubular 6 back and forth between well center and a stored position is illustrated diagrammatically, as is the unconstrained path where gripping assembly 46 is not carrying not a pipe stand and therefore is unconstrained in its translation path back and forth between the storage position and the position adjacent well center. It will be understood that gripping assembly 26 follows constrained path 66 and unconstrained path 68 underneath the plane containing first frame 16. The arm 24 rotates around axis A at the end of the diving board and then combines and coordinates rotation and extension to create a straight line movement of assembly 26.

Thus in the translation plot of FIG. 1 and the sequence of Views in FIGS. 12-19, home position is labeled by reference numeral 70 and is shown aligned with well center position 72 and the adjacent position 74 adjacent well center position 72. From hold position 70, and following constrained paths 66 the arc traveled by pipe stand 6 held in gripping assembly 26 follows a circular path 76 the radius R1 of which from axis of rotation A is governed by the retracted diameter of the parallelogram arms 24 and gripping assembly 26 and related rotating structure which is rotated by rotation drive 22. Thus with parallelogram arms 24 fully retracted underneath rotation drive 22, and with pipe stand 6 held in gripping assembly 26, pipe stand 6 is rotated between home position 70 and a 90 degree rotated position 78.

Once in position 78, pipe stand 6 is aligned with the corresponding aisle 12*a* of corridor 12 and so may be translated back and fourth along the aisle in direction F between position 78 and a slot-aligned position 80 aligned with the slot 18*a*. Slot 18*a* is the slot which is next to be filled with pipe stands being moved into their storage position between fingers 18 during running out the drill string and corresponding storage of pipe stands. The slot aligned with position 80 also corresponds to the slot 18*a* containing the next pipe stand to be removed from the racking board during the running back in of the drill string into the well. Thus because the controller knows the position in space at all times of gripping assembly 26 and also knows the position of fingers 18 and the frame 16 surrounding the fingers, and because the controller tracks or otherwise catalogues the inventory of pipe stands 6 held in slots 18*a* at any particular time, the processor associated with the controller may then determine which is the next most available space for storage of a pipe stand or determines which is the next most available pipe stand depending on whether the pipe stands are being stored or retrieved respectively. This next most available position is indicated by reference numeral 82. Thus although illustrated in FIG. 11 as being at one particular spot relative to the other positions in the constrained and unconstrained paths, it will be understood that position 82 moves with the next available position as determined by the processor. Therefore the length of the translation in direction G between positions 80 and 82 varies in length as does the length of the translation in direction F.

When moving the gripping assembly 26 between positions 82 and 74, the movement is unconstrained and hence the movement is illustrated diagrammatically as unconstrained paths 68 and shown as including intermediate positions 84 (where the clamping arms or head 46 have been removed from the pipe stand) and 86 (where the arm passes through its 90 degree position relative to direction F) as gripping assembly 26 translates in directions H and I. Once gripping assembly 26 is returned to position 74, gripping head 46 is aligned for a translation in direction J so as to mate clamping arms 52 onto the pipe stand at well center position 72 or so as to move the pipe stand being carried in clamping arms 52 into well center position 72.

Figure 2:
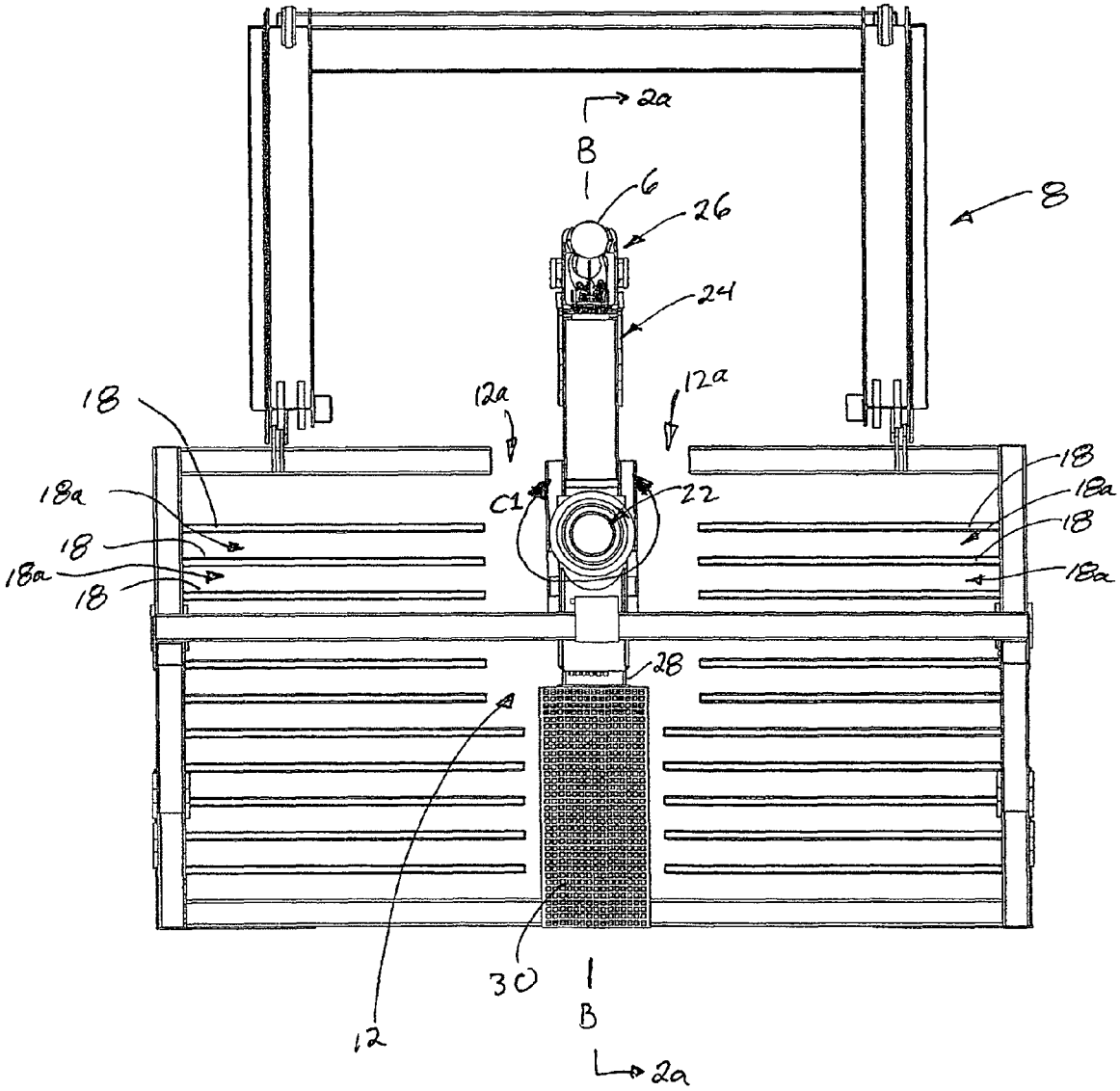
FIG. 2 is, in plan view, the apparatus of FIG. 1.
Figure 2A:
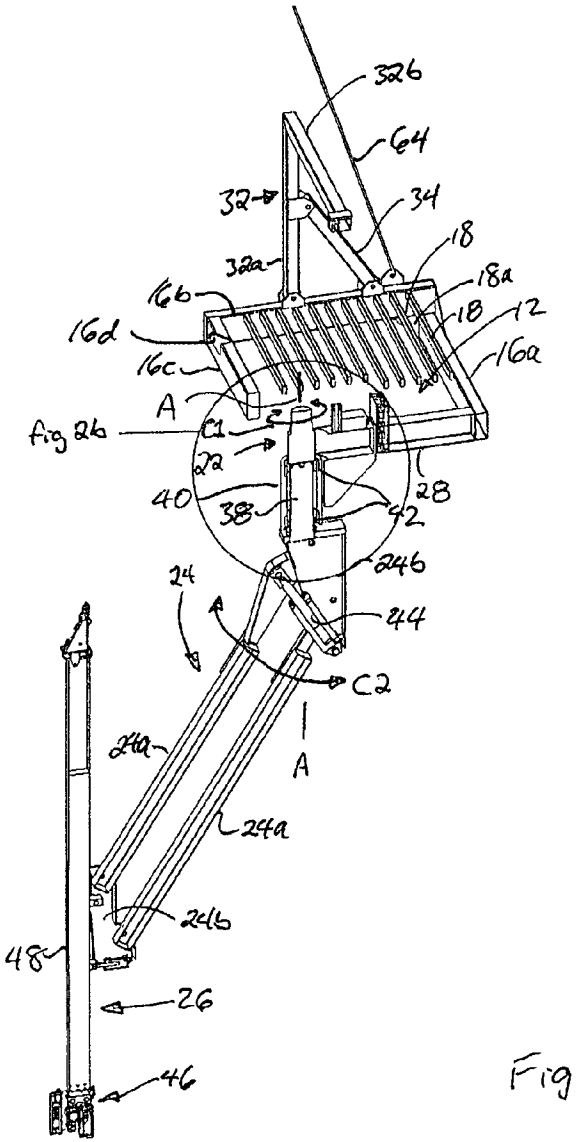
FIG. 2*a* is a section view along line 2*a*-2*a* in FIG. 2.
Figure 26:
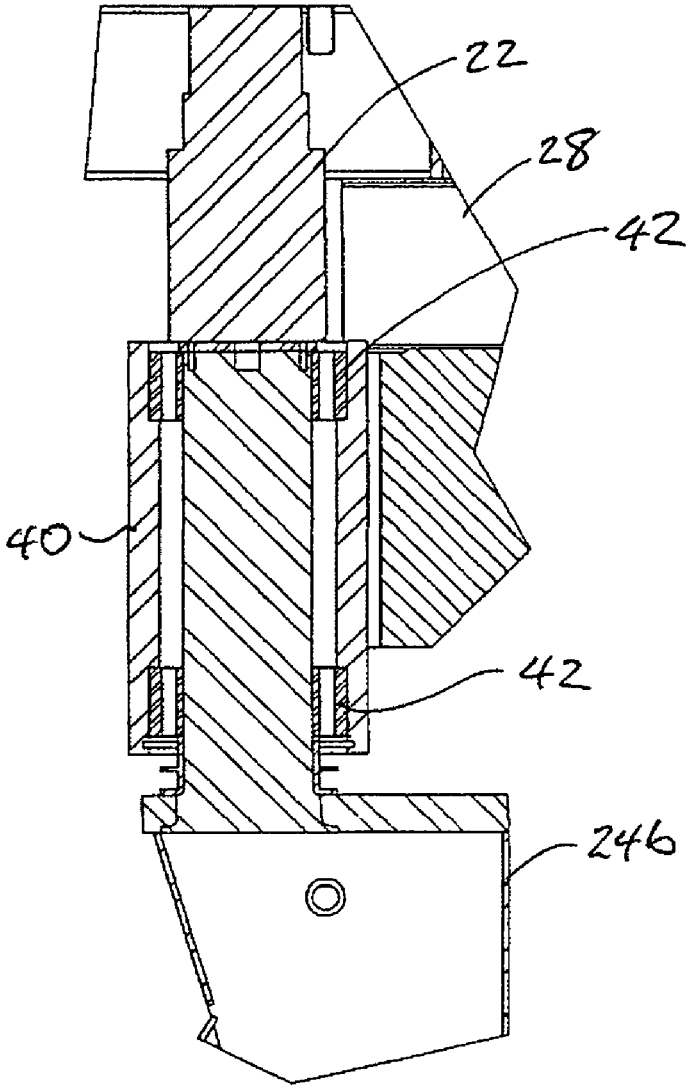
Figure 3:
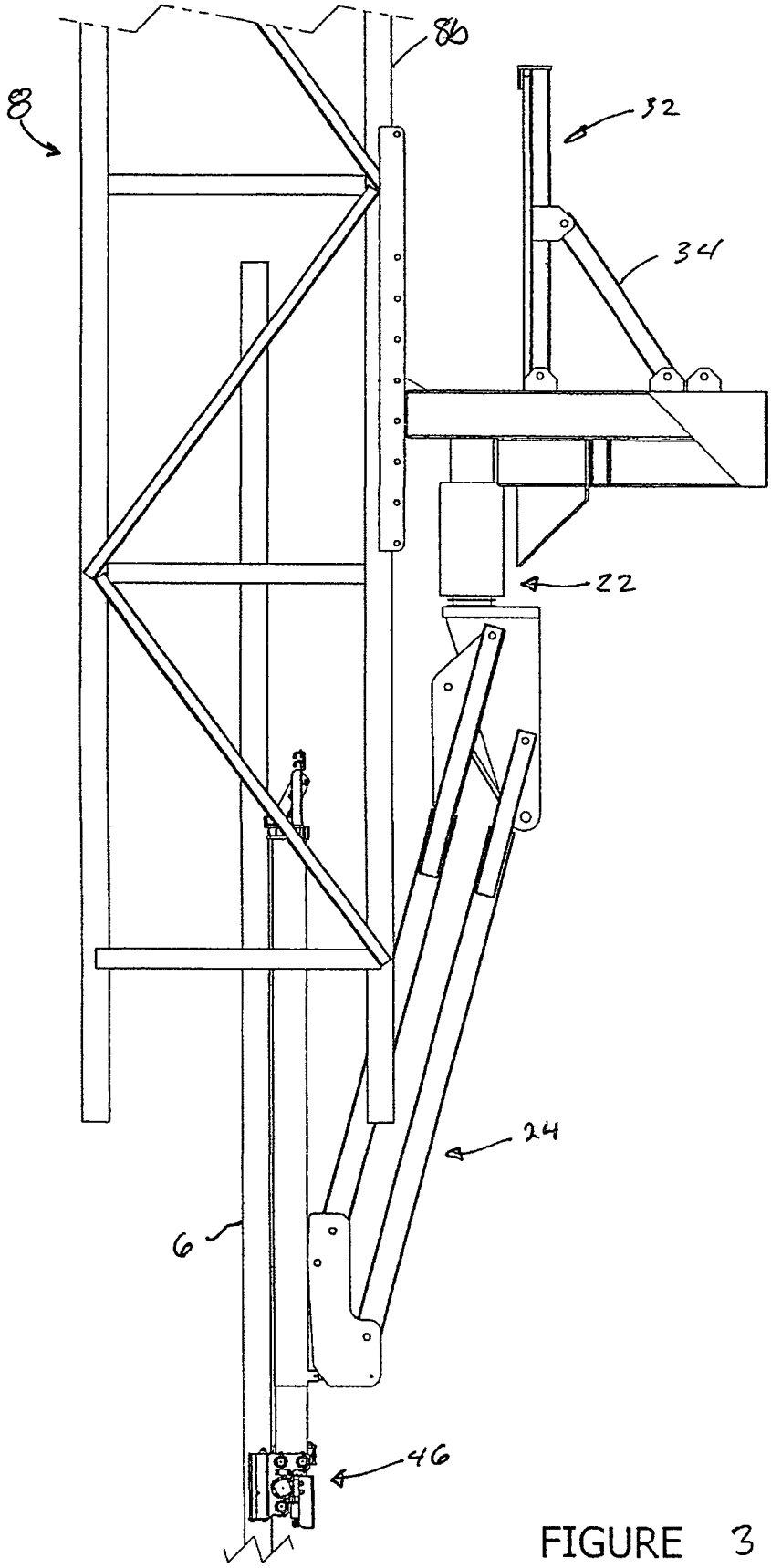
FIG. 3 is, in side elevation view, the apparatus of FIG. 1.
Figure 3A:
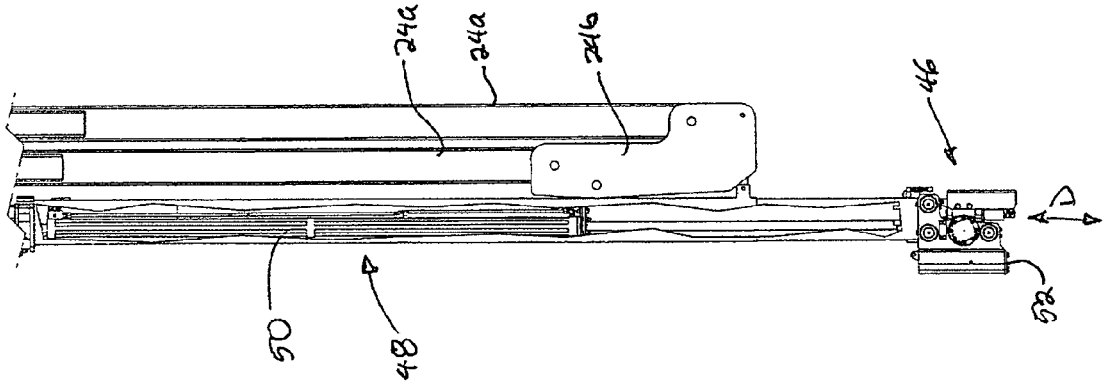
FIG. 3*a* is, in partially cut-way side elevation view, the manipulator arm and gripping head of FIG. 3 with the arm in the home position retracted underneath the rotation drive and with the gripping head extended downwardly therefrom.
Figure 26:
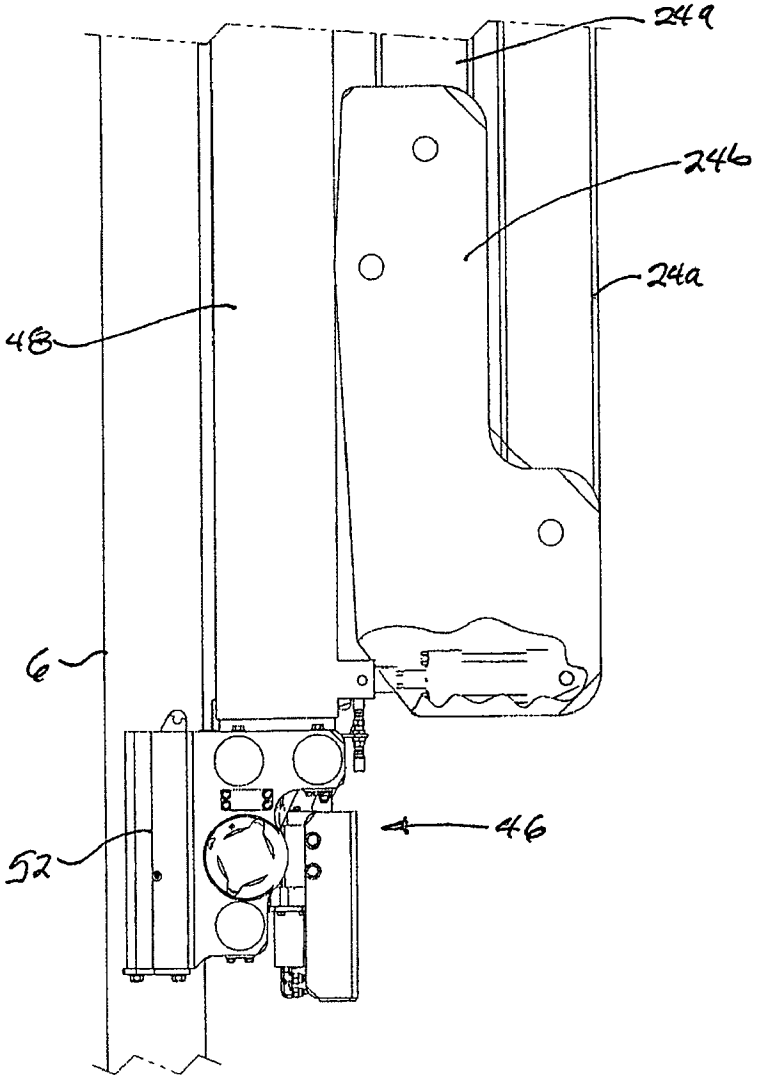
Figures 3C, 3D, 3E, 3F, 3G:
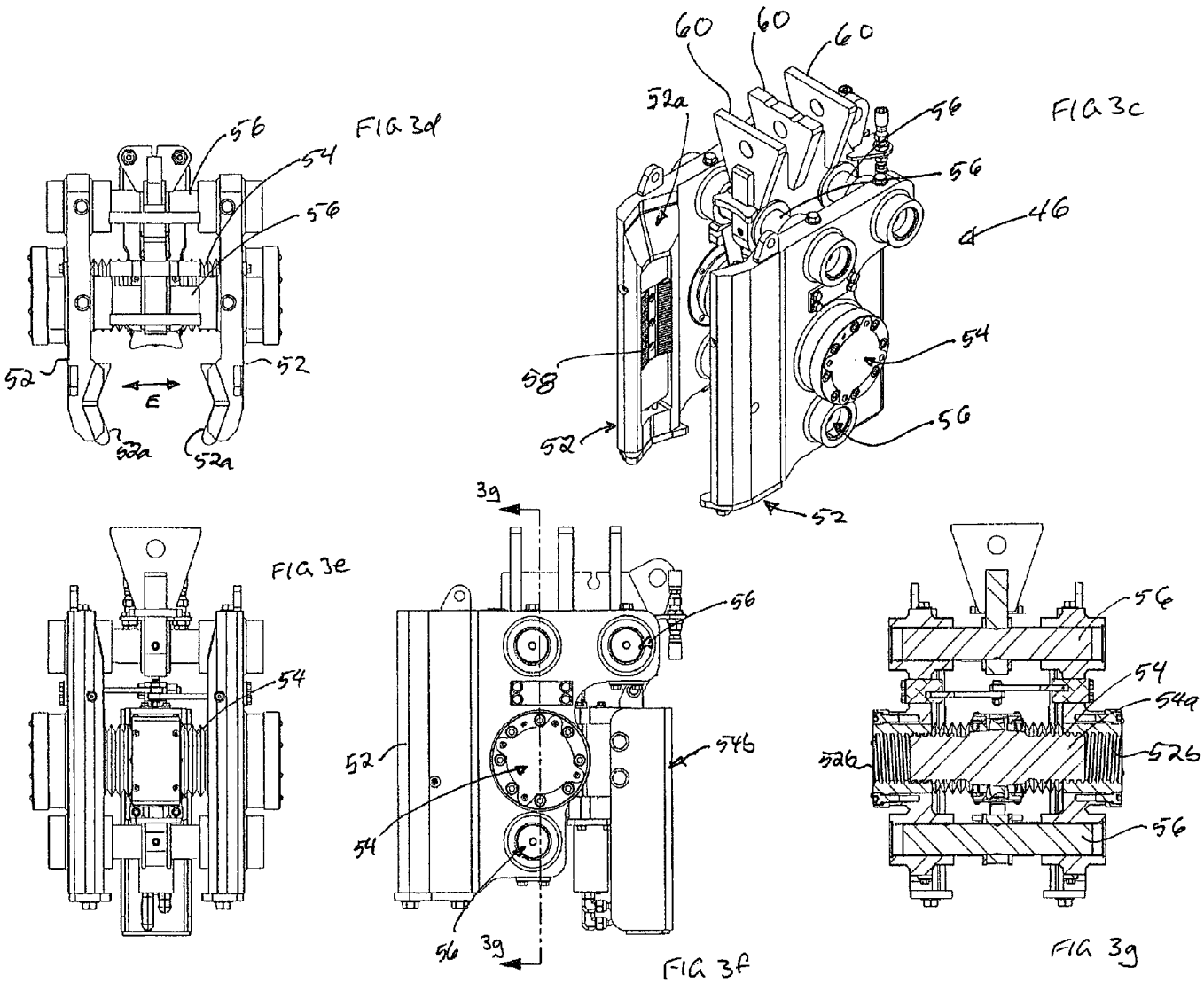
FIG. 3*c* is, in top perspective view, the gripping head of FIG. 3*b*.
FIG. 3*d* is, in plan view, the gripping head of FIG. 3*c*.
FIG. 3*e* is, in front elevation view, the gripping head of FIG. 3*c*.
FIG. 3*f* is, in side elevation view, the gripping head of FIG. 3*c*.
FIG. 3*g* is a sectional view along line 3*g*-3*g* in FIG. 3*f*.
Figure 4:
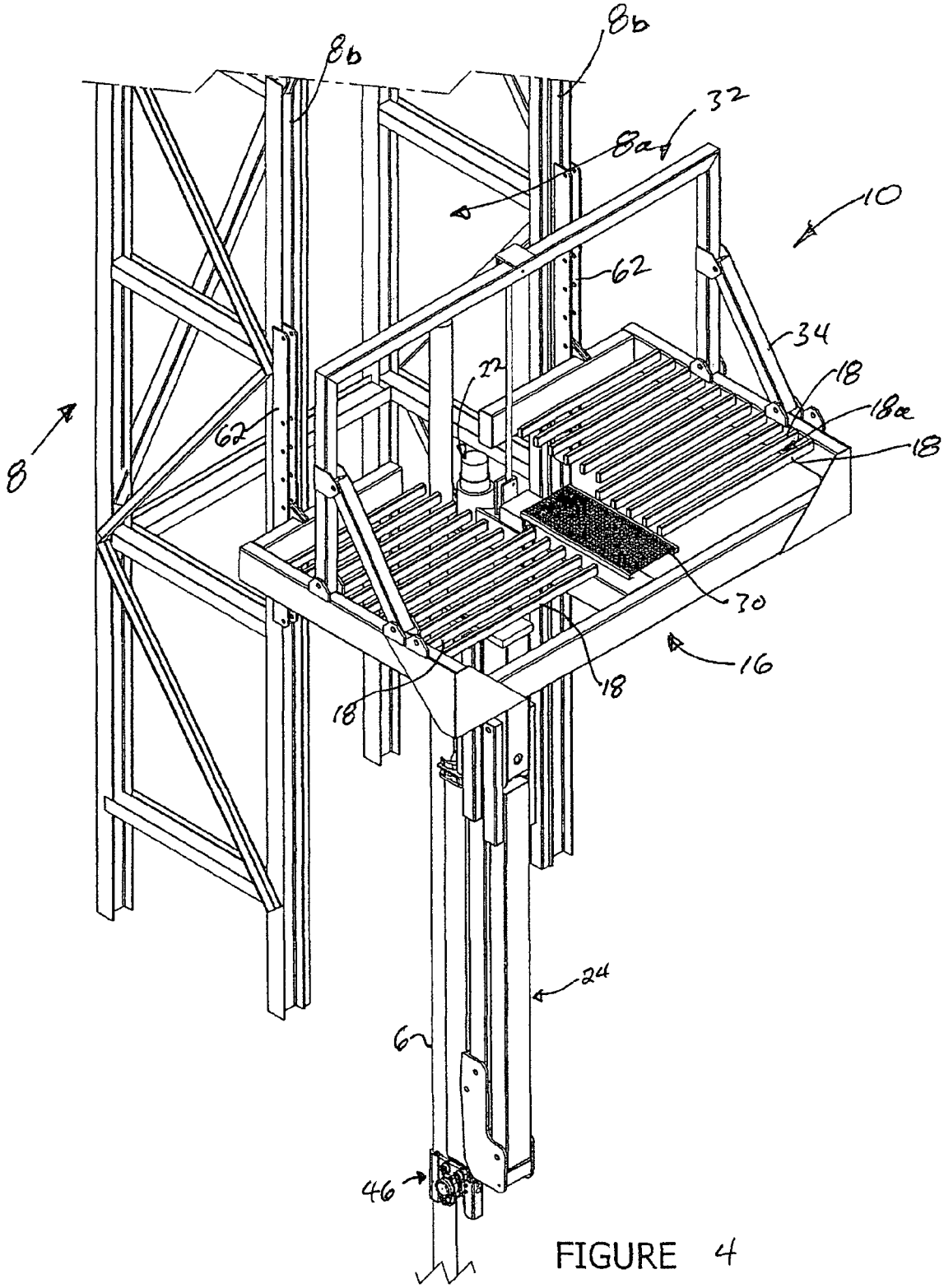
FIG. 4 is the top perspective view of FIG. 1 with the manipulating arm in its home position and the gripping head having lifted a pipe stand into the home position along and adjacent the manipulating arm.
Figure 5:
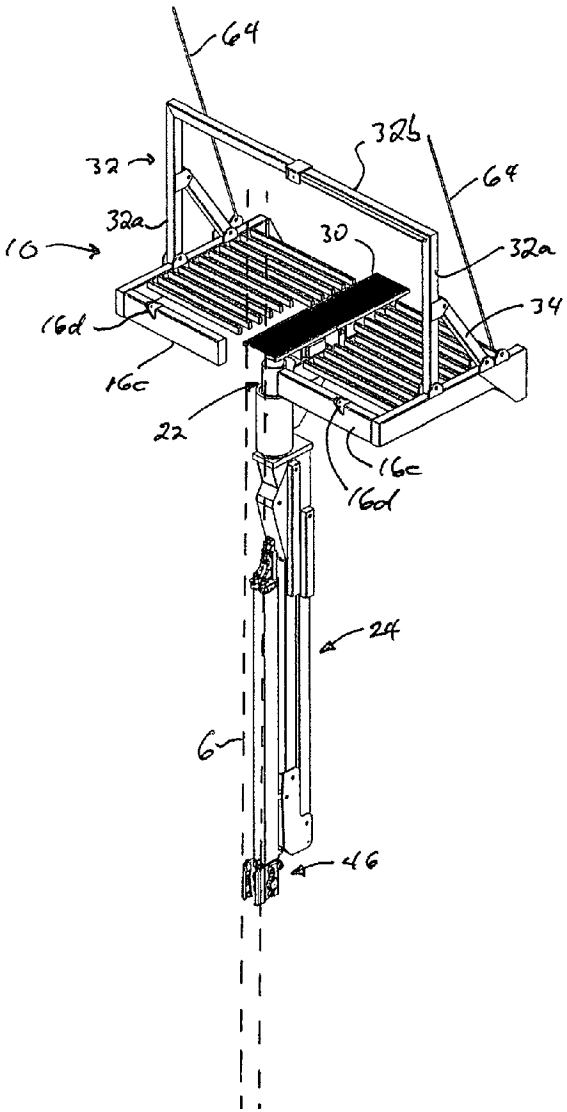
FIG. 5 is, in derrick-side top perspective view, the apparatus of FIG. 4 removed from the derrick and illustrating a pipe stand in dotted outline held in the gripping head. Showing an alternate embodiment having an extended diving board.
Figure 6:
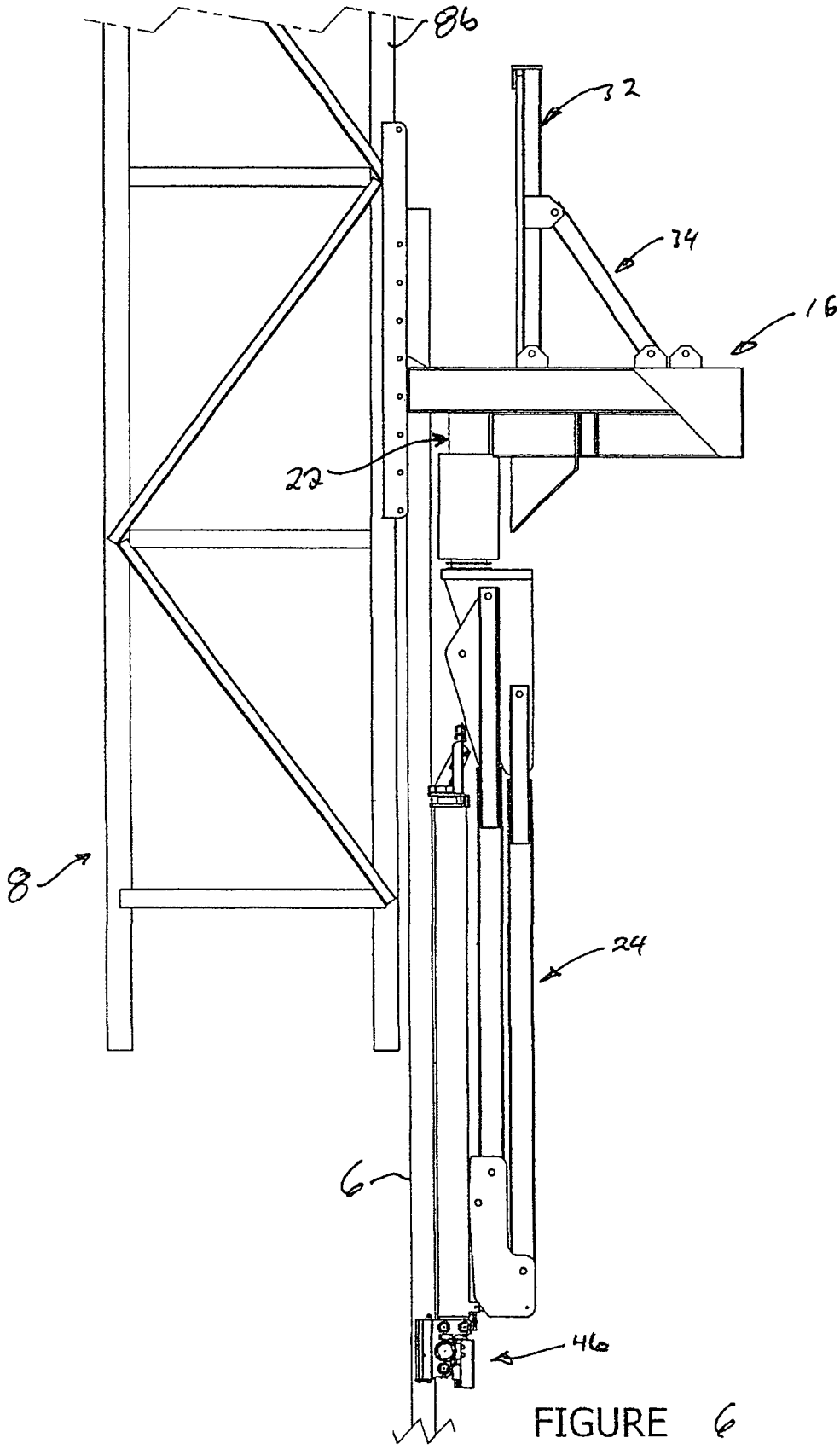
FIG. 6 is, in side elevation view, the apparatus of FIG. 4.
Figure 9:
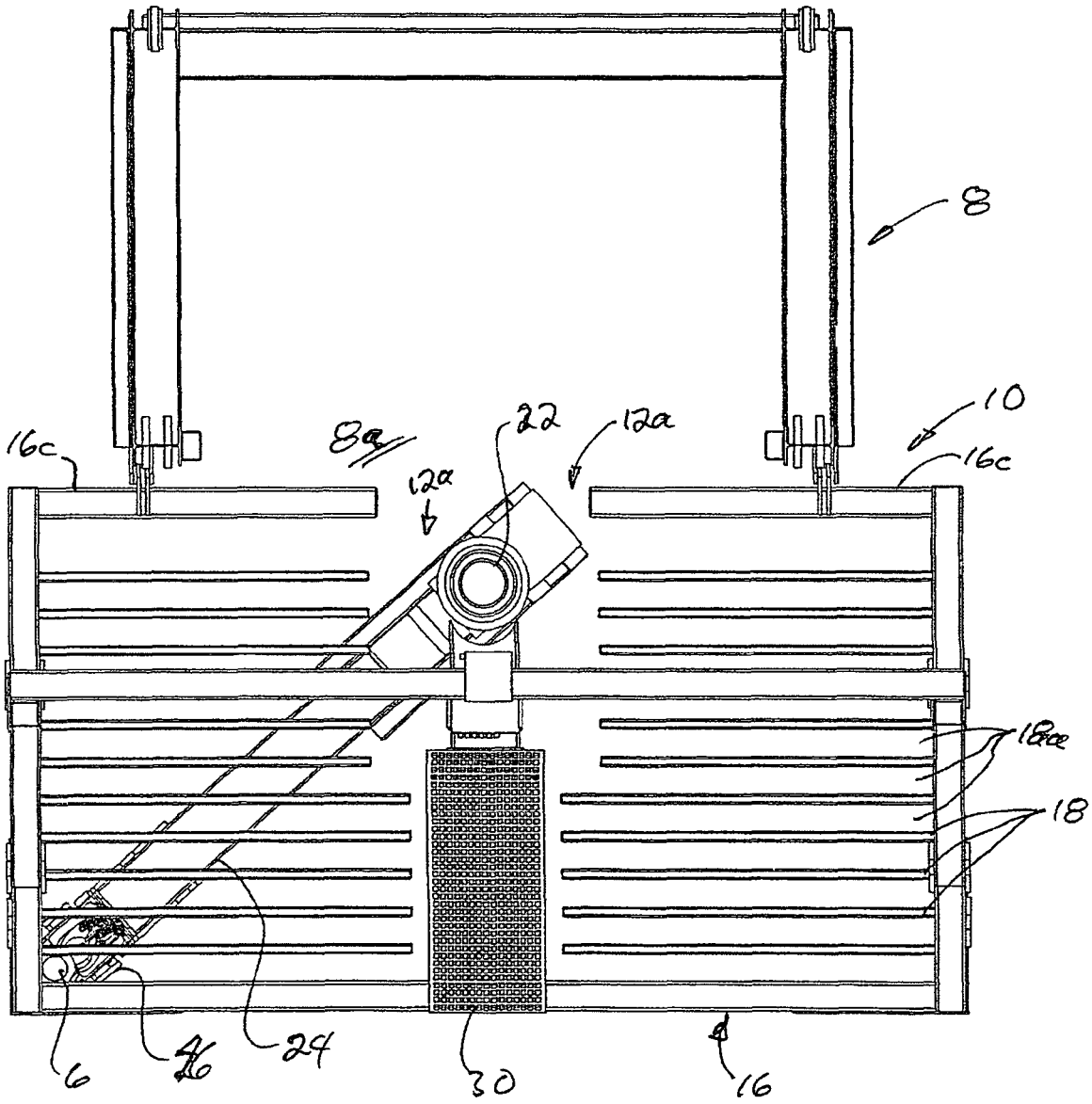
FIG. 9 is, in plan view, the apparatus of FIG. 8.
Figure 10:
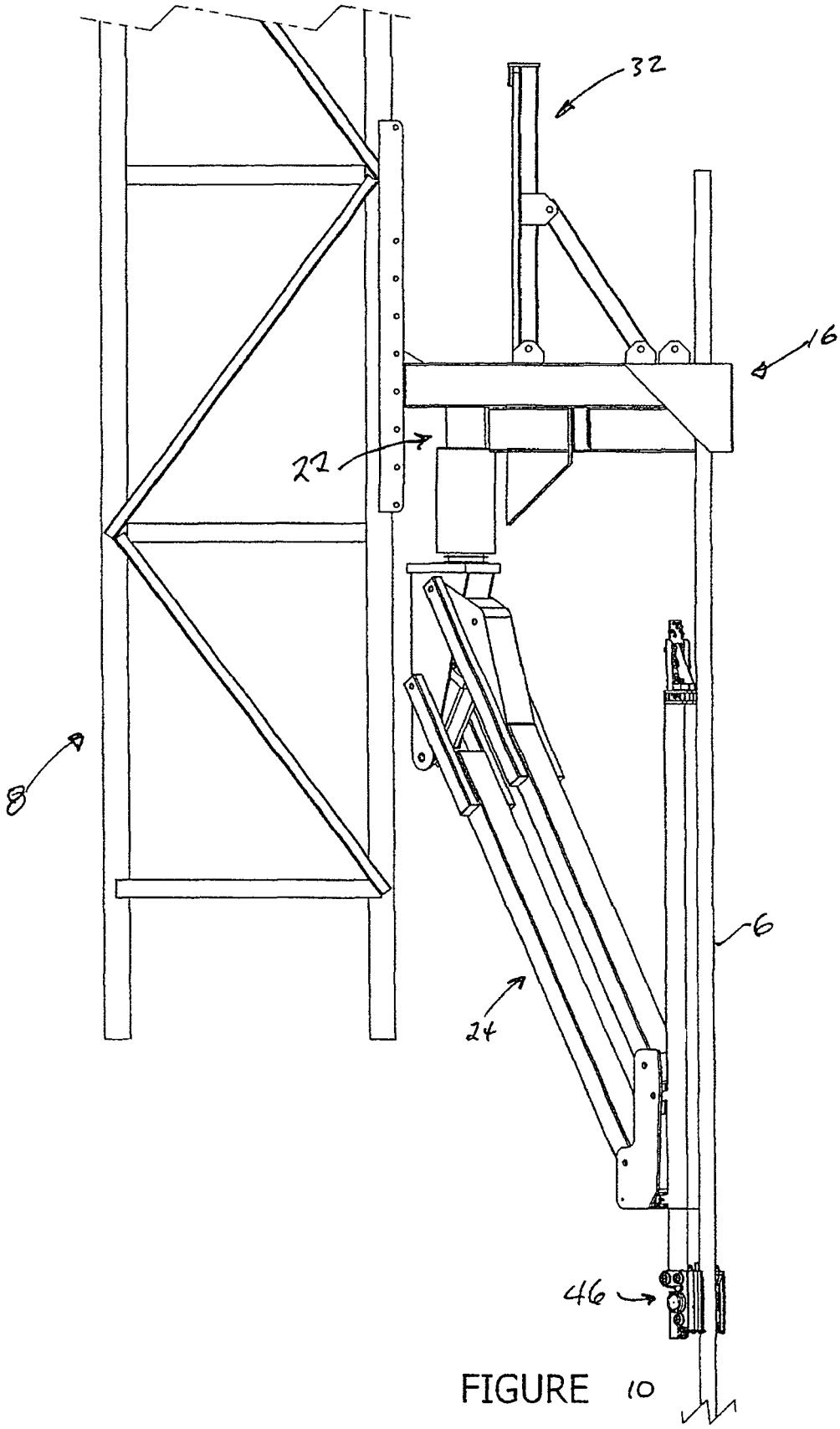
FIG. 10 is, in side elevation view, the apparatus of FIG. 8.

Thus in FIGS. 1-3, pipe stand 6 is shown in well center position 72. In FIGS. 4-7 pipe stand 6 is shown in home position 70, with pipe stand 6 only shown in dotted outline in FIG. 5. In FIGS. 8-10 pipe stand 6 is shown in a next most available position 82 which corresponds with the furthest reach required of the rotating and articulating assembly 20.

Figure 20:
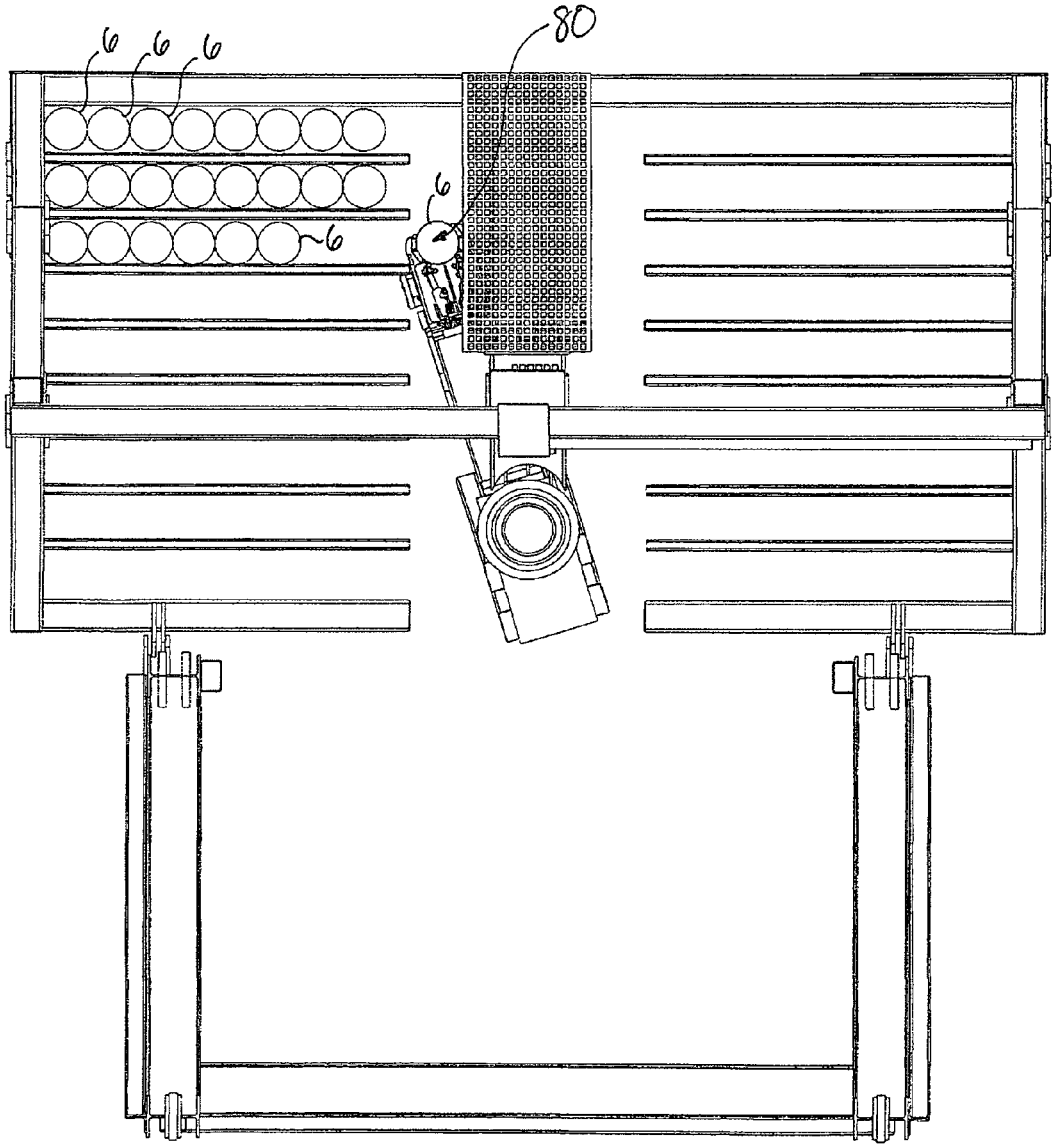
FIG. 20 is the view of FIG. 14 showing the gripping head in the slot aligned position when the next most available position is in the third finger space from the back wall of the racking board.
Figure 21:
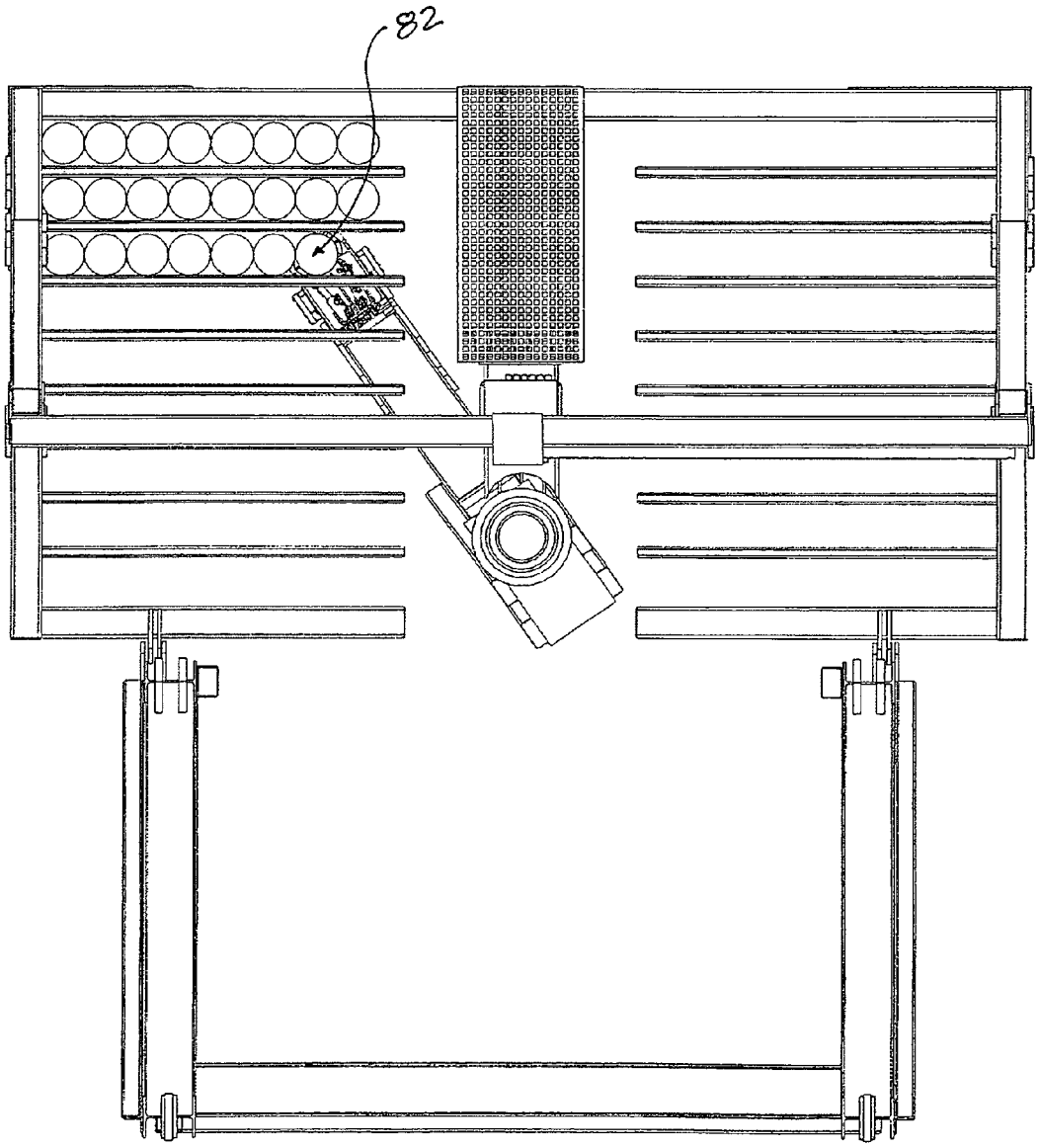
FIG. 21 is the view of FIG. 20 with the gripping head having positioned the pipe stand into the next most available position in the finger space being filled.

FIGS. 20 and 21 illustrated how positions 80 and 82 are adjusted by the processor controlling the arm positioning depending on how full the rack is. In those figures the third from the back finger spacing is being filled with pipes. As the rack fills with pipes in the case of filling back-to-front the trajectories of the arm are adjusted for a shorter travel in directions F and H as the rack fills. Travel in direction G gets shorter as each finger spacing is filled. The reverse happens as the rack is unloaded.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A pipe stand racking system comprising:

a racking board having a pair of opposed facing arrays of pipe stand supporting fingers mounted in a first frame, wherein said opposed facing arrays of pipe stand supporting fingers define an open corridor therebetween, and wherein said corridor extends from a derrick-side opening in said first frame to an opposite back-wall of said first frame opposite said derrick-side opening, and wherein said first frame is substantially horizontal when mounted to an open side of a derrick mast so as to register said corridor in cooperative alignment with the open side of the derrick mast, and wherein said first frame includes fasteners to mount a derrick-side of said first frame to the open side of the derrick mast into said cooperative alignment, an overhead second frame mounted to said first frame so as to extend over said first frame when said first frame is mounted to the derrick mast, an arm mounted to said second frame and depending downwardly from said second frame to a lower distal end of said arm positioned over said corridor, a cantilevered member mounted to said back wall of said first frame and extending therefrom cantilevered in a plane containing said corridor to a terminal end of said cantilevered member substantially coinciding with said lower distal end of said arm, a selectively controllable rotation drive mounted to said terminal end of said cantilevered member and said lower distal end of said arm, a parallelogram arm having a base end and an opposite pipe stand gripping end, said parallelogram arm mounted at said base end to said rotation drive for selectively positionable rotation of said parallelogram arm about an axis of rotation of said rotation drive, said parallelogram arm selectively actuable between a retracted position adjacent said axis of rotation and an extended position, a pipe stand gripper mounted at said pipe stand gripping end, wherein said parallelogram arm maintains a pipe stand gripped in said gripper substantially vertical when said first frame is mounted to the derrick and the pipe stand is translated by said parallelogram arm between said extended and retracted positions, and wherein, when said first frame is mounted to the derrick mast, in said extended position said parallelogram arm has a reach sufficient to position said gripper at well center when said rotation drive is in a first rotational position, and wherein when said rotation drive is in a second rotational position said reach of said parallelogram arm is sufficient to place a pipe stand held in said gripper into a rear-most finger space between said back wall of said first frame and an adjacent finger of corresponding said array of pipe stand supporting fingers, and wherein, when said parallelogram arm is in said retracted position, said gripper is rotatable by rotation of said parallelogram arm by said rotation drive along an arc having a retracted radius corresponding to rotation of said gripper and said parallelogram arm, and wherein said retracted radius allows rotation of said gripper about said axis of rotation within said corridor without interference with the ends of said fingers in said opposed facing arrays of pipe supporting fingers closest to said corridor whereby said gripper and said parallelogram arm are extendible between said retracted and extended positions when said rotation drive is in said first rotational position, and whereby said gripper and said parallelogram arm are rotatable by said rotation drive between said first and second rotational positions when said parallelogram arm is in said retracted position, wherein spacing between said cantilevered member and said terminal ends of said fingers define at least one corridor space for passing there-along an end of a pipe stand held in said gripper, whereby the weight of each pipe stand that is moved from well center to said racking board is transferred to front legs of the mast via said overhead second frame mounted above said racking board, and through said racking board to the derrick mast so as to support the weight of the pipe stand from above whereby each full pipe stand is lifted for positioning, wherein said second frame includes an inverted u-shaped frame member and said rod depends vertically downwards from said vertex position centered along said u-shaped frame member to support said rotation drive at least vertically, wherein said rod is parallel to said axis of rotation of said rotation drive.

2. The system of claim 1 further comprising a controller cooperating with said rotation drive and said parallelogram arm to control the position of said gripper, wherein said controller controls said position of said gripper along optimized constrained and unconstrained paths, wherealong said constrained path said gripper, while carrying a pipe stand, follows a first linear path along a finger space adjacent a selected finger of said arrays of fingers, and follows a second linear path along said at least one corridor space, on a side of said corridor between corresponding said terminal ends of said fingers corresponding to said finger space and said cantilevered member, around said arc defined by said retracted radius, and from adjacent said rotation drive to a well-center position in the derrick when un-racking a pipe stand from said racking board, and visca-versa when racking a pipe stand from well-center to said racking board, wherealong said unconstrained path said gripper, which unconstrained path said gripper follows only when not carrying a pipe stand, follows an arcuate optimized path from said selected finger space to a ready position set back from the well center awaiting a next pipe stand running in or out of the well, upon the arrival of which said gripper translates into a well center position closely adjacent the pipe stand, wherein accelerations and decelerations of said gripper and the pipe stand being carried along said constrained path are optimized to minimize pipe stand instability, to smooth motion of the pipe stand along said constrained path, and to minimize probability of impact of a pipe stand held by said gripper with said racking board during translation along said constrained path, and wherein rotational and extension motions are coordinated together to create straight line movement of said gripper and a pipe stand held therein along said first and second linear paths.

3. The system of claim 2 wherein said gripper includes a selectively vertically movable portion selectively vertically movable relative to said parallelogram arm, a gripping head mounted on said vertically movable portion wherein a pipe stand gripped in said gripping head is selectively vertically translatable independently of movement of said parallelogram arm.

4. The system of claim 3 wherein said vertically movable portion includes a selectively actuable telescopic portion for vertical telescopic translation of said gripping head.

5. The system of claim 3 further comprising a controller cooperating with said rotation drive and said parallelogram arm for positioning said gripper along said constrained and unconstrained paths, said controller adapted to catalogue a quantity and store position of each pipe stand stored in said racking board so as to position a subsequently retrieved pipe stand in an unoccupied storage position adjacent occupied storage positions and so as to retrieve next available pipe stands from occupied storage positions without interference with other pipe stands stored in said racking board.

6. The system of claim 5 wherein said controller cooperates with said vertically movable portion to elevate or lower a pipe stand held in said gripping head at well center prior to or subsequent to translation of said gripping head along said constrained path respectively.

7. The system of claim 2 wherein said second frame extends substantially orthogonally from said first frame.

8. The system of claim 7 wherein said rod is a rigid substantially linear member depending downwardly from a vertex position of said second frame substantially centered over said first frame.

9. The system of claim 2 further comprising a tension member mounted at a lower end thereof to a rear side of said first frame, and wherein an upper end of said tension member is mountable to an upper position of the derrick mast above where said racking board is mounted to the derrick mast, said tension member to support said rear side of said first frame and reduce a moment loading on said fasteners of said first frame where mounted to said derrick mast on a front side of said racking board.

10. The system of claim 9 wherein said tension member includes a pair of tension members spaced apart on opposite ends of said rear side of said first frame.

11. The system of claim 10 wherein said tension members are linear and wherein said fasteners are mounting brackets which include reinforcing plates mounted to the derrick mast, and which also include opposed facing leg portions of a front wall of said first frame opposite said back wall, wherein said opposed facing leg portions are mounted to said reinforcing plates so as to abut said leg portions against said reinforcing plates.

12. The system of claim 2 wherein said gripper is a single gripping head gripping the pipe stand at only a single location along its length.

* * * * *